US010822805B1

(12) United States Patent
LeBlanc et al.

(10) Patent No.: US 10,822,805 B1
(45) Date of Patent: Nov. 3, 2020

(54) WALL CONNECTING ASSEMBLY AND METHOD FOR CONNECTING A WALL PANEL TO A WALL STRUCTURE

(71) Applicant: Germain LeBlanc, Moncton, New Brunswick (CA)

(72) Inventors: Germain LeBlanc, Moncton (CA); Rachid Boukhili, Dollard-des-Ormeaux (CA); Mahmoud Abusrea, Pierrefonds (CA); Saad Filali, Victoriaville (CA)

(73) Assignee: Germain LeBlanc, Moncton (CA)

( * ) Notice: Subject to any disclaimer, the term of this patent is extended or adjusted under 35 U.S.C. 154(b) by 0 days.

(21) Appl. No.: 16/432,232

(22) Filed: Jun. 5, 2019

(51) Int. Cl.
*E04F 13/08* (2006.01)

(52) U.S. Cl.
CPC ..... *E04F 13/0801* (2013.01); *E04F 13/0862* (2013.01)

(58) Field of Classification Search
CPC ..... E04F 13/0801; E04F 13/0862
USPC .... 52/460, 463, 464, 459, 385, 235, 206.06, 52/506.05, 506.08, 506.09, 506.1, 510
See application file for complete search history.

(56) References Cited

U.S. PATENT DOCUMENTS 2,104,085 A * 1/1938 Leland ..... E04F 13/0841 52/276
2,447,694 A 8/1948 Finch
3,410,043 A * 11/1968 Rijnders ..... E04F 13/0803 52/506.08
3,745,736 A 7/1973 Fischer et al.
4,307,551 A * 12/1981 Crandell ..... E04F 13/0808 52/204.591
4,607,753 A * 8/1986 Radek ..... A47F 5/0846 211/189
4,782,635 A * 11/1988 Hegle ..... E04B 2/94 52/126.4
5,829,216 A * 11/1998 Newcomb ..... E04F 13/0807 52/395
6,438,913 B1 * 8/2002 Ishikawa ..... E04B 2/96 52/235

(Continued)

OTHER PUBLICATIONS

J. A. Milton Upholstery Supplies Ltd., "Wall / Panel Fixing brackets", https://www.jamiltonupholstery.co.uk/wall-panel-fixing-brackets, Jan. 9, 2019.

(Continued)

*Primary Examiner* — Brent W Herring
(74) *Attorney, Agent, or Firm* — Greensfelder, Hemker & Gale, P.C.; Richard C. Himelhoch

(57) ABSTRACT

The disclosure concerns a wall connecting assembly for mounting a wall panel to a wall structure, the wall connecting assembly comprising: a receiving plate adapted to be mounted to the wall structure, the receiving plate defining a receiving space and comprising a lower projection; a first connector comprising a mounting plate adapted to be at least partially slidably mounted within the receiving space and a first engaging portion, wherein the mounting plate abuts against the lower projection when the mounting plate is within the receiving space of the receiving plate; and a second connector being part of or being mounted to the wall panel and defining a second engaging portion adapted to register with the first engaging portion of the first connector. The disclosure also concerns a method for mounting a wall panel to a wall structure.

24 Claims, 13 Drawing Sheets

(56) References Cited

U.S. PATENT DOCUMENTS

| | | | | |
|---|---|---|---|---|
| 6,588,165 | B1 | 7/2003 | Wright | |
| 7,644,550 | B2 * | 1/2010 | Meyer | E04F 15/02405 248/158 |
| 7,726,083 | B2 * | 6/2010 | Wagner | E04F 13/0812 52/235 |
| 8,033,066 | B2 * | 10/2011 | Griffiths | E04F 13/081 52/235 |
| 8,205,406 | B2 * | 6/2012 | Hiscock | E04B 2/8611 52/309.16 |
| 8,322,102 | B2 | 12/2012 | Krieger | |
| 8,511,014 | B2 | 8/2013 | Delforte | |
| 8,511,023 | B1 | 8/2013 | Gulbrandsen et al. | |
| 8,707,648 | B2 * | 4/2014 | Timko | E04F 13/0819 52/476 |
| 8,973,330 | B2 * | 3/2015 | Egri, II | E04F 13/0805 248/231.81 |
| 9,045,898 | B2 | 6/2015 | Ravnaas | |
| 9,121,469 | B2 | 9/2015 | Downey et al. | |
| 9,200,439 | B1 * | 12/2015 | Egri, II | E04F 13/0805 |
| 9,562,361 | B2 | 2/2017 | Bilge | |
| 9,637,933 | B2 * | 5/2017 | Zhou | E04F 13/0801 |
| 10,100,529 | B2 * | 10/2018 | Marchesi | E04F 13/0801 |
| 2002/0134033 | A1 * | 9/2002 | Ishikawa | E04B 2/96 52/235 |
| 2008/0010922 | A1 * | 1/2008 | Wagner | E04F 13/0812 52/235 |
| 2009/0241444 | A1 * | 10/2009 | Griffiths | E04F 13/0842 52/235 |
| 2009/0241451 | A1 * | 10/2009 | Griffiths | E04F 13/081 52/309.4 |
| 2011/0083392 | A1 * | 4/2011 | Timko | F16B 5/065 52/582.1 |
| 2011/0094183 | A1 * | 4/2011 | Gasperi | E04B 1/4107 52/705 |
| 2011/0140325 | A1 * | 6/2011 | Downey | E04B 1/98 267/141.1 |
| 2011/0289872 | A1 * | 12/2011 | Hiscock | E04B 2/8611 52/220.1 |
| 2011/0302865 | A1 | 12/2011 | Kliegle et al. | |
| 2012/0186170 | A1 * | 7/2012 | Macdonald | E04F 13/0805 52/235 |
| 2016/0244967 | A1 * | 8/2016 | Zhou | E04F 13/0801 |
| 2017/0260751 | A1 * | 9/2017 | Zhou | E04F 13/0801 |
| 2017/0298634 | A1 * | 10/2017 | Marchesi | E04F 13/0801 |

OTHER PUBLICATIONS

Modernsolid Healthcare, "Wall Mount Track System", http://www.mms-healthcare.com/Wall-Mount-Track-System-la251.html, Jan. 9, 2019.

* cited by examiner

WALL CONNECTING ASSEMBLY AND METHOD FOR CONNECTING A WALL PANEL TO A WALL STRUCTURE

FIELD OF THE INVENTION

The invention relates to wall connecting assemblies that are configured to connect a wall panel to a wall structure and to methods for connecting a wall panel to a wall structure.

BACKGROUND

Wall panels can be used to decorate and/or improve the sound and/or thermal insulation of a building; such wall panels are usually mounted to a face of a wall structure at selected locations in order to provide the desired aesthetic and/or insulation effect. Wall panels and wall structures may be made from any number of materials.

Different wall connecting assemblies exist that are configured to connect a wall panel to a wall structure. However, such wall connecting assemblies are often complex to be used and/or complex to be manufactured and/or do not provide a sufficiently strong connection between the wall panel and the wall structure, in particular in areas where extreme weather conditions (such as storm, rainfalls, snowfalls . . . ) occur.

In view of the above, there is a need for a wall connecting assembly which would be able to overcome or at least minimize some of the above-discussed prior art concerns.

SUMMARY OF THE INVENTION

It is therefore an aim of the present invention to address the above-mentioned issues.

According to a general aspect, there is provided a wall connecting assembly for mounting a wall panel to a wall structure, the wall panel having an inner face and the wall structure having a face to be at least partially covered by the wall panel. The wall connecting assembly comprises a receiving plate adapted to be mounted to the face of the wall structure, the receiving plate defining a receiving space and comprising a lower projection extending from a lower portion of the receiving plate; a first connector comprising a mounting plate adapted to be at least partially slidably mounted within the receiving space and a first engaging portion extending from the mounting plate toward the inner face of the wall panel when the wall structure is at least partially covered by the wall panel, wherein the mounting plate abuts against the lower projection when the mounting plate is within the receiving space of the receiving plate; and a second connector being part of or being mounted to the inner face of the wall panel and defining a second engaging portion adapted to register with the first engaging portion of the first connector such that, when the first and second engaging portions engage together, the wall panel is at least partially connected to the wall structure.

According to another general aspect, there is provided wall system, comprising a wall structure having a face; a wall panel for at least partially covering the face of the wall structure, the wall panel having an inner face; and a plurality of wall connecting assemblies. Each wall connecting assembly comprises: (i) a receiving plate adapted to be mounted to the face of the wall structure, each receiving plate defining a receiving space and comprising a lower projection extending from a lower portion of the receiving plate, (ii) a first connector comprising a mounting plate adapted to be at least partially slidably mounted within the receiving space of the receiving plate and a first engaging portion extending from the mounting plate toward the inner face of the wall panel when the wall structure is at least partially covered by the wall panel, wherein the mounting plate abuts against the lower projection when the mounting plate is within the receiving space of the receiving plate, and (iii) a second connector being part of or being mounted to the inner face of the wall panel and defining a second engaging portion adapted to register with the first engaging portion such that, when the first and second engaging portions of each connecting assembly engage together, the wall panel is connected to the wall structure.

According to another general aspect, there is provided method for covering a face of a wall structure. The method comprises mounting a receiving plate to the face of the wall structure, the receiving plate defining a receiving space and comprising a lower projection extending from a lower portion of the receiving plate; providing a first connector comprising a mounting plate adapted to be at least partially slidably mounted within the receiving space and a first engaging portion extending from the mounting plate; mounting the first connector to the receiving plate by sliding the mounting plate within the receiving space and then by abutting the mounting plate against the lower projection such that the mounting plate is within the receiving space of the receiving plate; providing a wall panel having a second connector being part of or being mounted to an inner face of the wall panel, the second connector defining a second engaging portion adapted to register with the first engaging portion of the first connector; and engaging together the first and second connectors such that the wall panel is at least partially connected to the wall structure.

DETAILED DESCRIPTION OF EMBODIMENTS

Figure 1A:
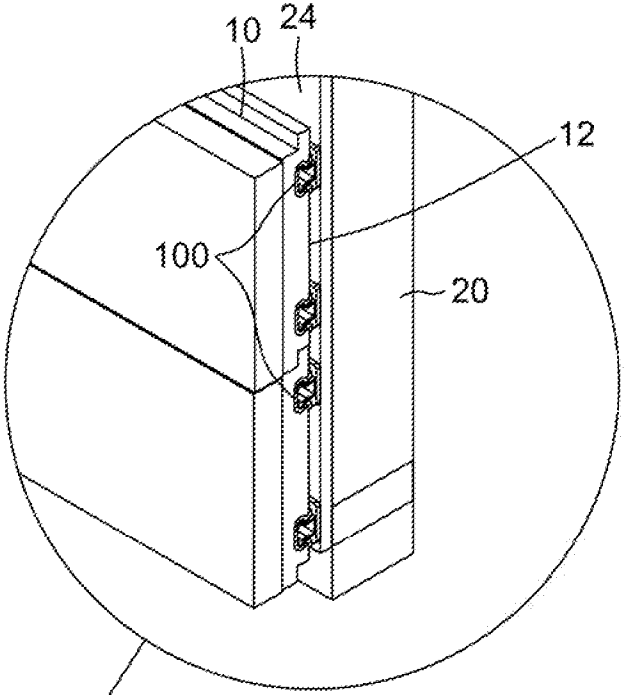
FIG. 1A is an enlarged view of the connection of the wall panel to the wall structure of FIG. 1.
Figure 1:
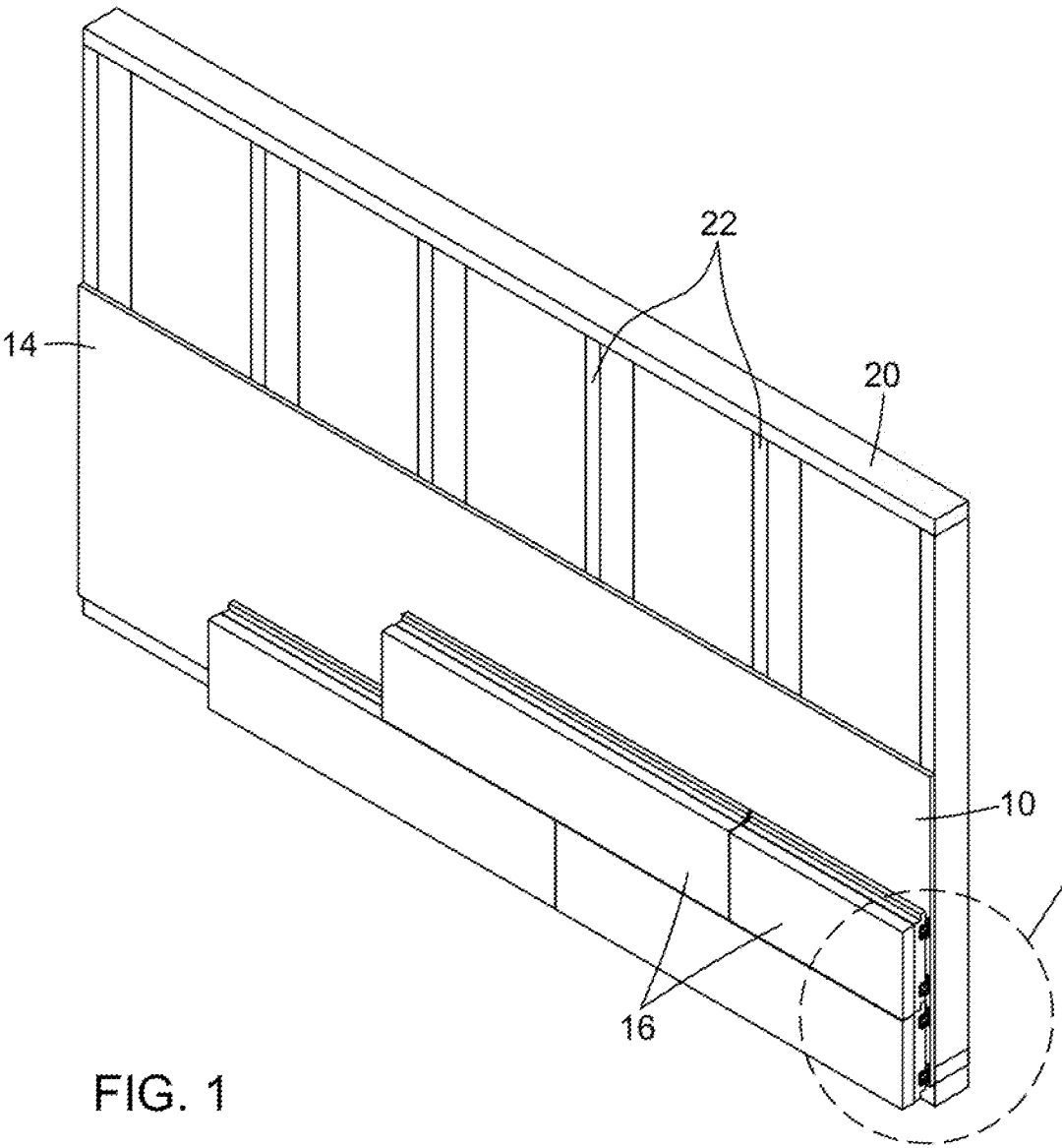
FIG. 1 is a perspective side view of a wall panel connected to a wall structure via a wall connecting assembly in accordance with an embodiment, the wall connecting assembly comprising a first connector and a second connector.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "forward", "rearward", "left", "right" and the like should, unless otherwise indicated, be taken in the context of the figures only and should not be considered limiting. Moreover, the figures are meant to be illustrative of certain characteristics of the wall connecting assembly and are not necessarily to scale.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, an embodiment is an example or implementation. The various appearances of "one embodiment", "an embodiment" or "some embodiments" do not necessarily all refer to the same embodiments. Although various features may be described in the context of a single embodiment, the features may also be provided separately or in any suitable combination. Conversely, although the invention may be described herein in the context of separate embodiments for clarity, it may also be implemented in a single embodiment. Reference in the specification to "some embodiments", "an embodiment", "one embodiment" or "other embodiments" means that a particular feature, structure, or characteristic described in connection with the embodiments is included in at least some embodiments, but not necessarily all embodiments.

It is to be understood that the phraseology and terminology employed herein is not to be construed as limiting and are for descriptive purpose only. The principles and uses of the teachings of the present disclosure may be better understood with reference to the accompanying description, figures and examples. It is to be understood that the details set forth herein do not construe a limitation to an application of the disclosure.

Furthermore, it is to be understood that the disclosure can be carried out or practiced in various ways and that the disclosure can be implemented in embodiments other than the ones outlined in the description above. It is to be understood that the terms "including", "comprising", and grammatical variants thereof do not preclude the addition of one or more components, features, steps, or integers or groups thereof and that the terms are to be construed as specifying components, features, steps or integers. If the specification or claims refer to "an additional" element, that does not preclude there being more than one of the additional element. It is to be understood that where the claims or specification refer to "a" or "an" element, such reference is not be construed that there is only one of that element. It is to be understood that where the specification states that a component, feature, structure, or characteristic "may", "might", "can" or "could" be included, that particular component, feature, structure, or characteristic is not required to be included.

The descriptions, examples, methods and materials presented in the claims and the specification are not to be construed as limiting but rather as illustrative only. Meanings of technical and scientific terms used herein are to be commonly understood as by one of ordinary skill in the art to which the invention belongs, unless otherwise defined. It will be appreciated that the methods described herein may be performed in the described order, or in any suitable order.

Variants, examples and preferred embodiments of the invention are described hereinbelow. More particularly, referring to FIGS. 1 to 7, there is shown a wall connecting assembly 100 configured to connect a wall panel 10 to a wall structure 20.

For instance and without being limitative, the wall panel 10 is a decorative panel, a panel having thermal and/or sound insulating properties or any other type of panel that can be mounted to a wall structure (either inwardly or outwardly). The wall panel has a first face 12 (or wall structure face 12 or inner face) and an opposed second face 14 (or outer face). In the embodiment shown, pavements 16 are mounted to the second face 14 of the wall panel 10. It could also be conceived a wall panel 10 having pavements or other ornamental and/or insulating pavements 16 that would be formed integral therewith, in which case the outer face 14 would be formed at least partially by outer faces of the pavements. It could also be conceived a wall panel 10 with no pavements secured thereto. For instance and without being limitative, the wall panel 10 has a length (i.e. considered along a horizontal direction) comprised between about 50 cm and about 150 cm. In some embodiments, the length of the wall panel 10 is about 100 cm. For instance and without being limitative, the wall panel 10 has a height (i.e. considered along a vertical direction) comprised between about 10 cm and about 30 cm. In some embodiments, the height of the wall panel 10 is about 20 cm. For instance and without being limitative, the wall panel 10 has a thickness (i.e. considered along a horizontal direction) comprised between about 2 cm and about 10 cm. In some embodiments, the thickness of the wall panel 10 is about 5 cm. For instance and without being limitative, the wall panel 10 has a weight between about 1 kg and about 20 kg. In some embodiments, the weight of the wall panel 10 is between about 3 kg and about 15 kg. In some other embodiments, the weight of the wall panel 10 is about 10 kg.

For instance and without being limitative, the wall structure 20 is configured to form a wall portion of a building. In the embodiment shown, the wall structure 20 comprises a plurality of substantially vertically extending beams 22. The beams 22 are spaced-apart from each other and define together a face 24 (or wall panel face). In the embodiment shown, the face 24 of the wall structure 20 is discontinuous but it could also be conceived a wall structure 20 with a face 24 forming a substantially continuous wall surface.

As detailed below, the wall connecting assembly 100 can be configured to connect directly the inner face 12 of the wall panel 10 to the face 24 of the wall structure 20, or indirectly (for instance via a connecting panel, as described below).

As represented in particular in FIGS. 4 to 7, the wall connecting assembly 100 comprises a receiving plate 110 to be secured to the face 24 of the wall structure 20. The receiving plate 110 defines a receiving space 112 and comprises a lower projection 114 extending from a lower portion of the receiving plate 110.

The wall connecting assembly 100 further comprises a first connector 130 comprising a mounting plate 132 at least partially slidably mountable within the receiving space 112 of the receiving plate 110. The mounting plate 132 is shaped and dimensioned to abut against the lower projection 114 of the receiving plate 110 when mounted within the receiving space 112. The first connector 130 also comprises a first engaging portion 140 extending from the mounting plate 132.

The wall connecting assembly 100 also comprises a second connector 160 being part of or being mounted to the face 12 (or wall structure face or inner face) of the wall panel 10 and comprising a second engaging portion 162 adapted to register with the first engaging portion 140 of the first connector 130 such that, when the first and second engaging portions 140, 162 engage together, the wall panel 10 is at least partially connected to the wall structure 20.

Figure 5:
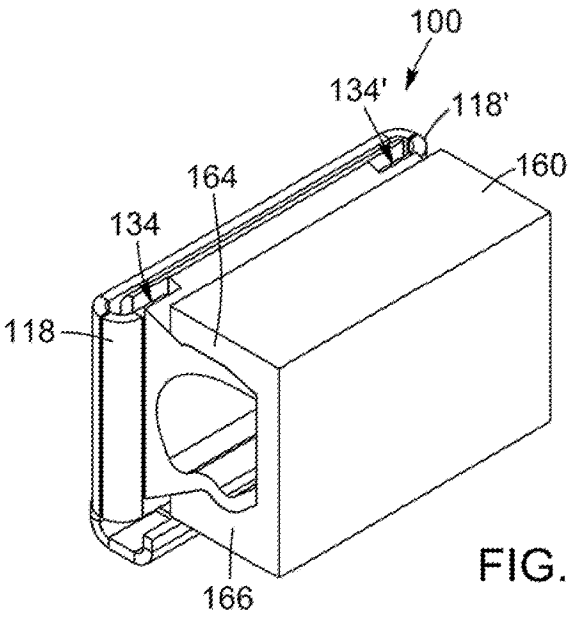
FIG. 5 is a front perspective view of the wall connecting assembly of FIG. 4.
Figure 4:
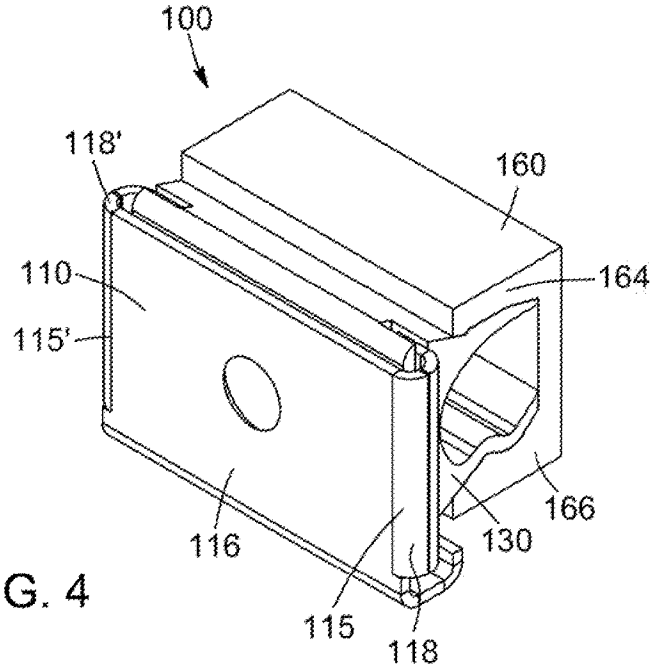
FIG. 4 is a rear perspective view of a wall connecting assembly in accordance with another embodiment, configured in an assembled configuration, the wall connecting assembly comprising a first connector and a second connector.
Figure 6:
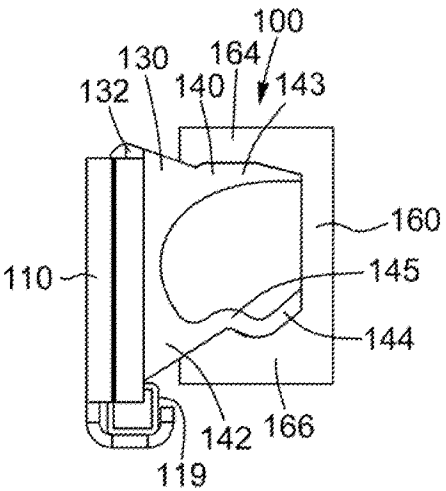
FIG. 6 is a side elevational view of the wall connecting assembly of FIG. 4.

As detailed below, the wall connecting assembly 100 is shaped and dimensioned so that, in use (i.e. when the wall connecting assembly 100 is configured into an assembled configuration, as represented in FIGS. 4 to 6), the first connector 130 is mounted to the receiving plate 110 for the first connector 140 to extend outwardly from the receiving space 112 of the receiving plate 110 and the second connector 160 is mounted to the first connector 130 in order to connect the wall panel 10 to the wall structure 20.

The different components of the wall connecting assembly 100 will now be described in more details, with reference to FIGS. 4 to 7, 25 and 26.

Receiving Plate

As represented in FIGS. 4 to 7, the receiving plate 110 comprises a back-wall portion 116 delimiting at least partially the receiving space 112. In the embodiment shown, the back-wall portion 116 is substantially planar.

The receiving plate 110 further comprises left and right vertical protections 118, 118' spaced-apart from each other and extending outwardly from the back-wall portion 116 and towards each other. The left and right vertical projections 118, 118' and the back-wall portion 116 partially delimit together the receiving space 112.

In the embodiment shown, the receiving plate 110 comprises a plate body 113 forming at least partially the back-wall portion 116 and comprising left and right lateral edges 115, 115'. The left and right vertical projections 118, 118' are at least partially formed by folding respectively the left and right lateral edges 115, 115' of the plate body 113.

In the embodiment shown, the left and right vertical projections 118, 118' are formed integral with the back-wall portion 116. It could also be conceived a receiving plate in which the left and right vertical projections would be distinct from the back-wall portion and would be secured (for instance glued, riveted or welded) to left and right edges of the back-wall portion 116.

The left and right vertical projections 118, 118' each comprise a distal portion 121, 121' facing the back-wall portion 116 and spaced-apart thereof. For instance, the distal portions 121, 121' extend substantially parallel to the back-wall portion 116 and define therewith left and right sliding cavities 123, 123'.

In the embodiment shown, a mounting hole 120 is formed in the back-wall portion 116. For instance and without being limitative, the mounting hole 120 is formed substantially centrally in the back-wall portion 116. For instance, the mounting hole 120 is substantially circular. It could also be conceived a mounting hole formed somewhere else in the back-wall portion and/or having a different shape. It could also be conceived a receiving plate 110 having a plurality of mounting holes formed therein. The mounting hole 120 is configured to mount—or secure—the receiving plate 110 to the wall structure 20 (and more particularly to the wall panel face 24 thereof). For instance, the mounting hole 120 is configured to receive a screw or any other suitable mechanical fastener to secure the receiving plate 110 to the face 24 of the wall structure 20.

In the embodiment shown, the back-wall portion 116 comprises a lower portion 122 and the lower projection 114 comprises a blocking protrusion 124 extending outwardly (i.e. on a same side of the back-wall portion 116 as the left and right vertical projection 118, 118' in a substantially horizontal direction) from the lower portion 122 of the back-wall portion 116. It is thus understood that the lower projection 114 partially delimits the receiving space 112.

In the embodiment shown, the plate body 113 that forms at least partially the back-wall portion 116 comprises a lower edge 117. The blocking protrusion 124 is at least partially formed by folding the lower edge 117 of the plate body 113. In the embodiment shown, the blocking protrusion 124 is thus formed integral with the back-wall portion 116. It could also be conceived a receiving plate in which the blocking protrusion would be distinct from the back-wall portion 116 and would be secured (for instance glued, riveted or welded) to a lower edge of the back-wall portion 116.

In the embodiment shown, as represented in FIG. 6, the blocking protrusion 124 has a substantially U-shaped cross-section. Moreover, in the embodiment shown, the folded lower edge 117 of the plate body 113 has a substantially J-shaped cross-section.

Figure 7:
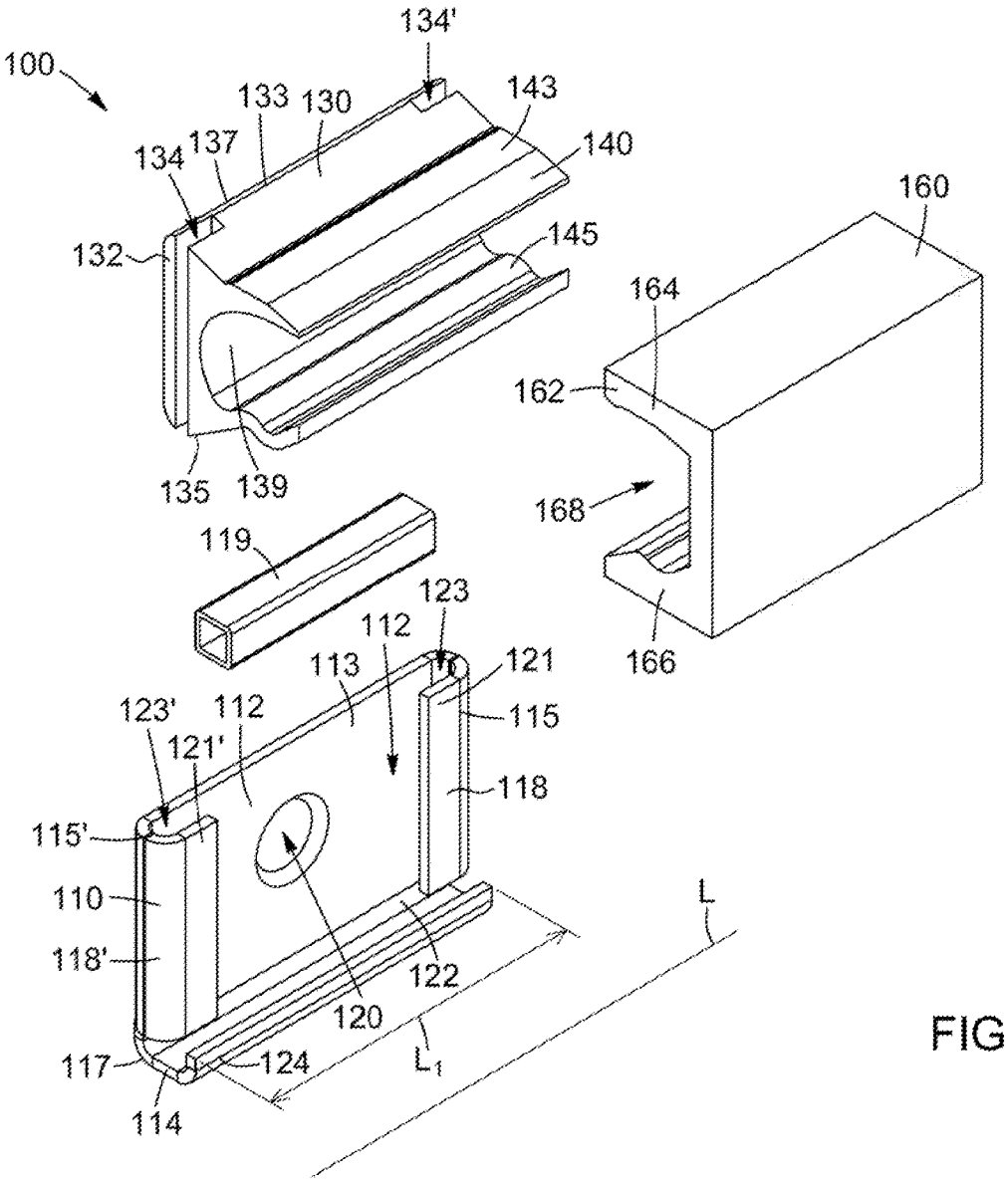
FIG. 7 is an exploded view of the wall connecting assembly of FIG. 4.

As represented in FIGS. 6 and 7, the lower projection 114 further comprises a dampening element 119 arranged (for instance secured by being glued) on an upper face (or inner face, considered with reference to the receiving space 112) of the lower projection 112 (for instance on an upper face of the blocking protrusion 124). For instance and without being limitative, the dampening element 119 could be made at least partially of a flexible and elastic material, such as rubber, silicon . . . . The dampening element 119 could have a substantially square cross-section, as in the embodiment shown, or any other shape, such as a substantially cylindrical shape. The dampening element 119 could further comprise one or more springs or any other component configured to damp or cushion the downward sliding (i.e. along a substantially vertical direction) of the mounting plate 132 of the first connector 130 within the receiving space 112.

In the embodiment shown, the receiving plate 110 defines a longitudinal direction L. The dampening element 119 extends along at least about 50% of a length L1 of the blocking protrusion 124. In some other embodiments, the dampening element 119 extends along at least about 65% of the length L1 of the blocking protrusion 124. In some other embodiments, the dampening element 119 extends along at least about 75% of the length L1 of the blocking protrusion 124. In yet some other embodiments, the dampening element 119 extends along substantially entirely the length L1 of the blocking protrusion 124. In the embodiment shown, the dampening element 119 extends between the distal portions 121, 121' of the left and right vertical projections 118, 118'.

Figure 27:
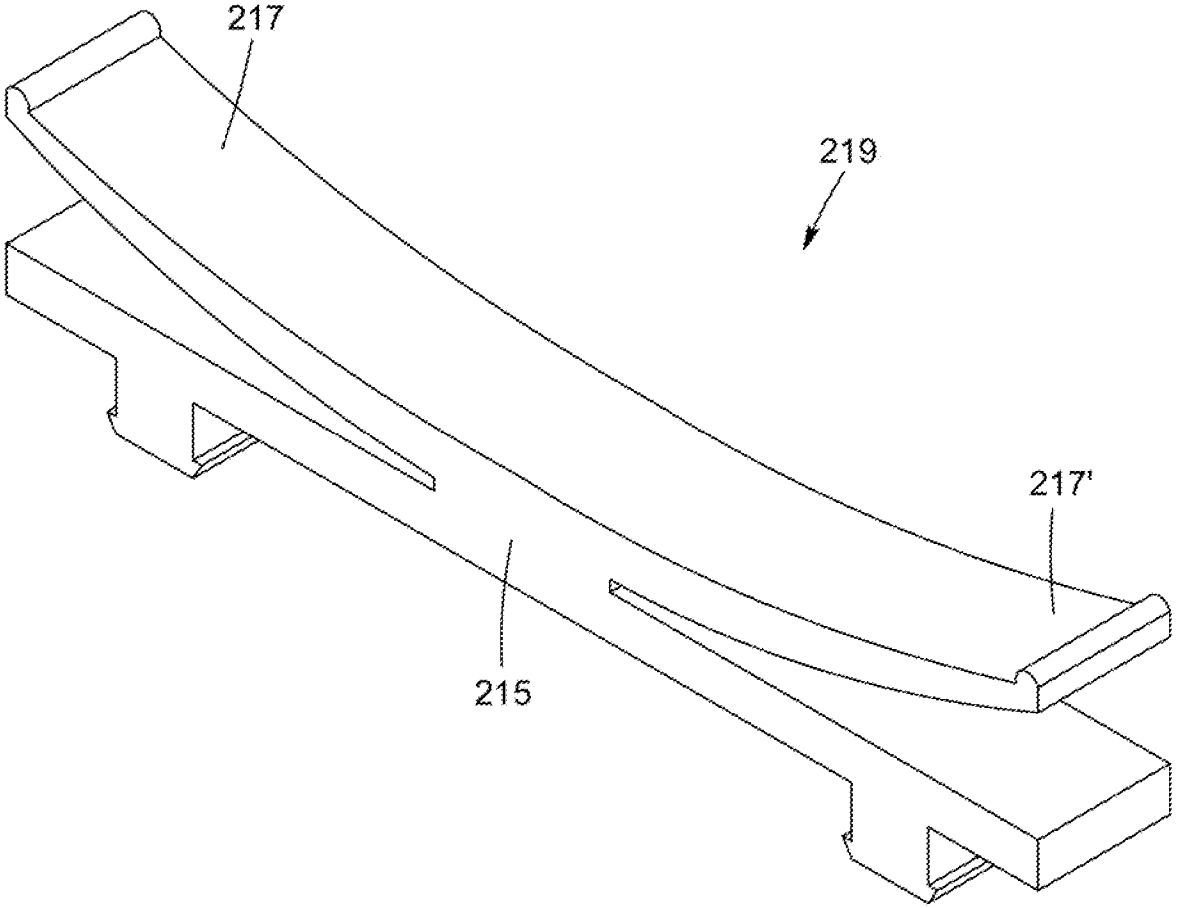
FIG. 27 is a front perspective view of a dampening device in accordance with an embodiment.

FIG. 27 represents another possible embodiment of the dampening element 219. In the embodiment shown, the dampening element 219 is shaped and designed to be received on the upper face of the lower projection 112. The dampening element 219 comprises a base 215 and left and right dampening tabs 217, 217' protruding from an upper face of the base 215. The left and right dampening tabs 217, 217' are flexibly and resiliently mounted to the base 215, so as to damp or cushion the downward sliding (i.e. along a substantially vertical direction) of the mounting plate 132 of the first connector 130 within the receiving space 112.

Figure 10A:
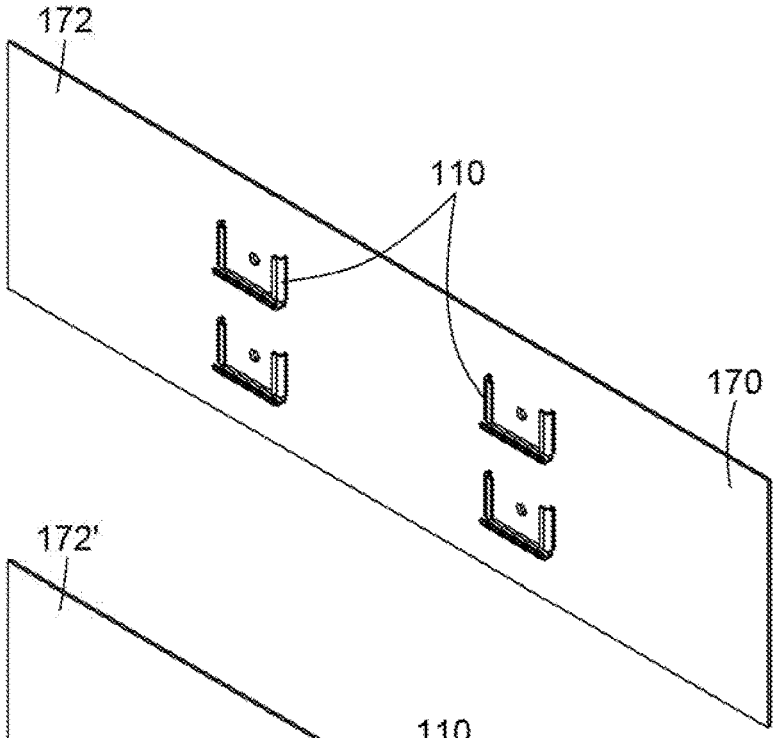
FIGS. 10A, 10B and 10C are front perspective views of different embodiments of connecting panels comprising a plurality of receiving plates.
Figure 10B:
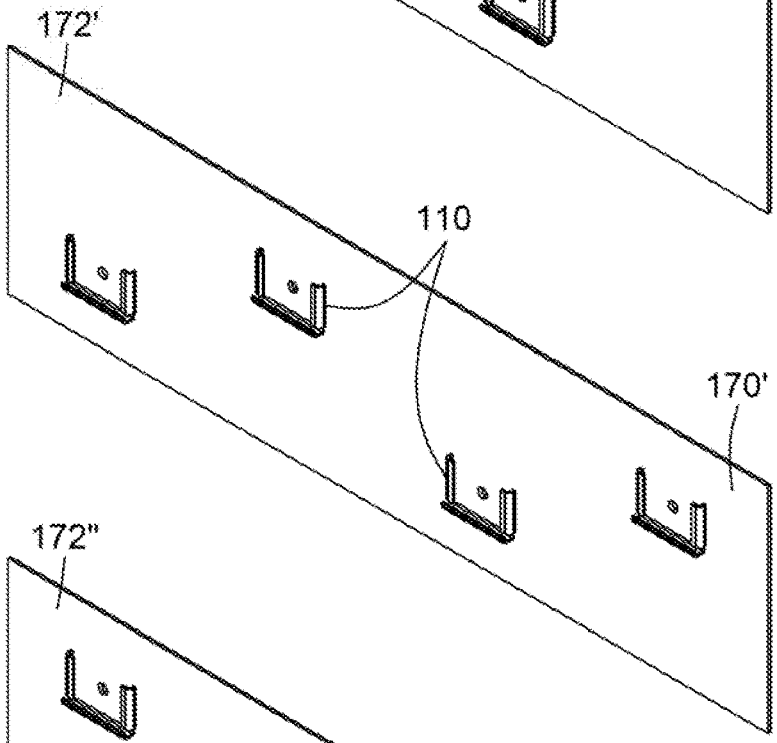
Figure 10C:
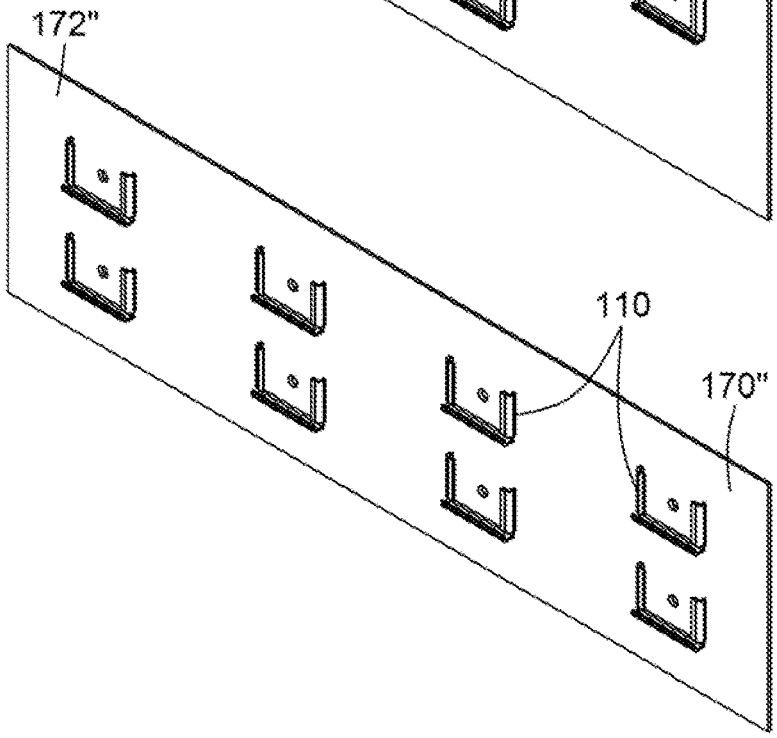

In some embodiments, a plurality of receiving plates 110 are arranged together to form a connecting panel 170, 170', 170", as represented in FIGS. 10A to 10C. The connecting panel 170, 170, 170" is securable to the face 24 (or wall panel face 24) of the wall structure 20. The connecting panels 170, 170', 170" comprise a plurality of receiving plates 110 that can be vertically aligned with each other, horizontally aligned with each other and/or in alternating configurations with each other. In the embodiment shown, the back-wall portion 116 of the different receiving plates 110 is made integral with a panel body 172, 172', 172" of the connecting panels 170, 170', 170". It could also be conceived a connecting panel in which the receiving plates would be distinct from the panel body and secured thereto.

In the embodiments shown, the receiving plates 110 of the connecting panels 170, 170', 170" comprise at least one mounting hole 120, so that the connecting panels 170, 170', 170" can be secured to the wall structure 20 via adapted mechanical fasteners extending through the mounting holes 120. It could also be conceived connecting panels with receiving plates 110 having no mounting holes formed therein; the connecting panels 170, 170', 170" could thus be securable to the wall structure 20 by securing to the face 24 of the wall structure 20 a face of the connecting panels 170, 170', 170" opposed to a face delimiting partially the receiving spaces 112 of the receiving plates 110. It is appreciated that the shape, the configuration, the number and the location of the receiving plates 110 can vary from the embodiments shown.

Figure 9:
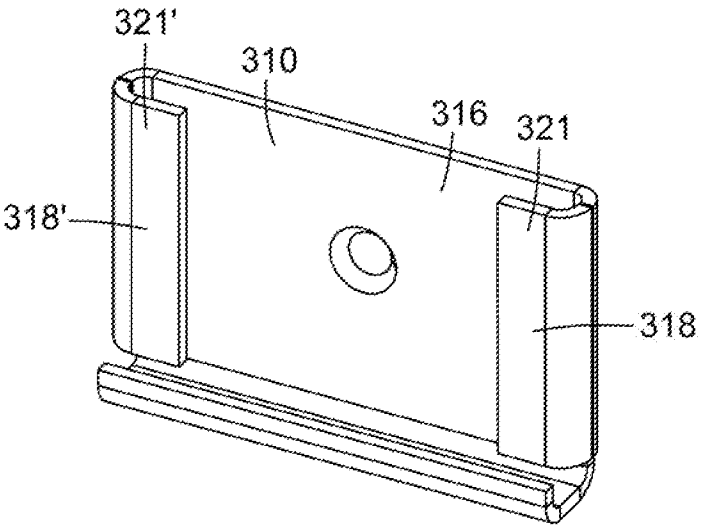
FIG. 9 is a front perspective view of a receiving plate of a wall connecting assembly in accordance with another embodiment.
Figure 8:
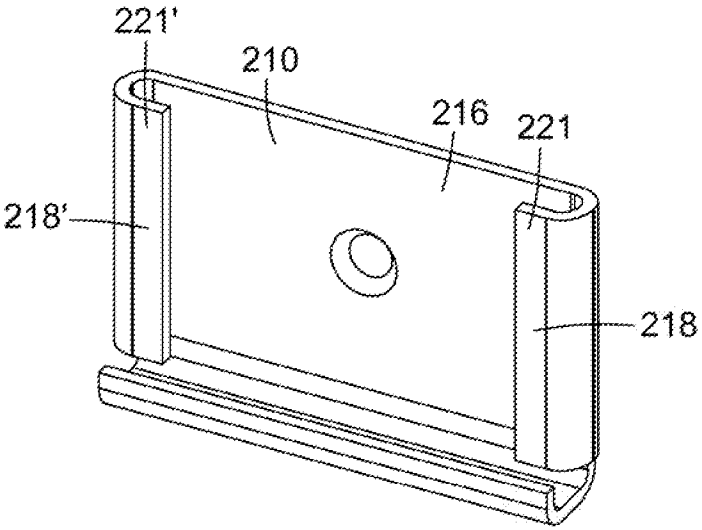
FIG. 8 is a front perspective view of a receiving plate of a wall connecting assembly in accordance with another embodiment.

It is appreciated that the shape and the configuration of the receiving plate 110, for instance the shape, the configuration and the location of the left and right vertical projections 118, 118', the lower projection 114 and the receiving space 112, can vary from the embodiment shown. For instance and without being limitative, the dimensions of the left and right vertical projections with regards to the back-wall portion can vary from the embodiment shown. As represented in FIGS. 8 and 9, the dimensions of the distal portions 221, 221', 321, 321' of the left and right vertical projections 218, 218', 318, 318' with regards to the back-wall portion 216, 316 can differ from the first embodiment of the receiving plate 110. For instance, even though in the embodiment shown, the lower projection 114 is formed at a lower portion of the receiving plate 110, its location is not limited to the disclosed embodiment. The projection 114 (or abutting projection) could be located anywhere else on the receiving plate 110, as long as it is shaped and designed to limit the vertical translation of the mounting plate 132 of the first connector 130 within the receiving space 112 of the receiving plate 110.

In the embodiments shown, the receiving plates 110, 210, 310 define a vertical plane of symmetry; the plane of symmetry is perpendicular to the plane defined by the back-wall portion.

First Connector

In the embodiment shown and represented in FIGS. 4 to 7, the first engaging portion 140 of the first connector 130 is of a male type and the second engaging portion 162 of the second connector 160 is of a female type. It could be conceived a wall connection assembly in which the first and second engaging portions would be inverted.

In the embodiment shown, left and right mounting grooves 134, 134' are formed in the mounting plate 132 (in left and right end portions thereof). In the embodiment shown, the left and right mounting grooves 134, 134' are substantially vertical and are shaped and dimensioned to slidably receive respectively the left and right vertical projections 118, 118' of the receiving plate 110. It is thus understood that the left and right sliding cavities 123, 123' defined by the left and right vertical projections 118, 118' are shaped and dimensioned to receive at least a portion of left and right edges of the mounting plate 132. In the embodiment shown, the left and right mounting grooves 134, 134' extend from an upper edge 133 of the mounting plate 132 to a lower edge 135 thereof (i.e. extend along an entirety of a height of the mounting plate 132). It is appreciated that the shape, the number, the configuration, and the location of the left and right mounting grooves 134, 134' with regards to the mounting plate 132 can vary from the embodiment shown.

In the embodiment shown, the first engaging portion 140 has a proximal end portion 142 connected to the mounting plate 132 (by being formed integral therewith, in the embodiment shown but could be secured thereto, in case the first engaging portion 140 would be distinct from the mounting plate 132) and an opposed distal end portion 144. The first engaging portion 140 is tapered toward the distal end portion 144. In other words, considered in a plane substantially perpendicular to the plane defined by the mounting plate 132 (as represented in FIG. 6), the cross-section of the first engaging portion 140 decreases towards the distal end portion 144.

The mounting plate 132 comprises an inner face 137 (with regards to the receiving space 112) facing the receiving plate 110 when mounted thereto and an opposed outer face 139. The first engaging portion 140 comprises upper and lower projections 143, 145 extending from the outer face 139 of the mounting plate 132. The upper and lower projections 143, 145 are flexibly connected to the mounting plate 132. For instance, the upper and lower projections 143, 145 is at least partially made of a resilient material such that, when the first and second engaging portions engage together, the upper and lower projections are biased toward the second engaging portion. It is thus understood that the upper and lower projections 143, 145 are shaped and designed—for instance due to their material—to be flexibly connected to the mounting plate 132.

At least one of the upper and lower projections 143, 145 (both, in the embodiment shown) extends in a substantially horizontal direction when the wall connecting assembly 100 is in use (i.e. when the mounting plate 132 of the first connector 130 is received in the receiving space 112 of the receiving plate 110).

Figure 25:
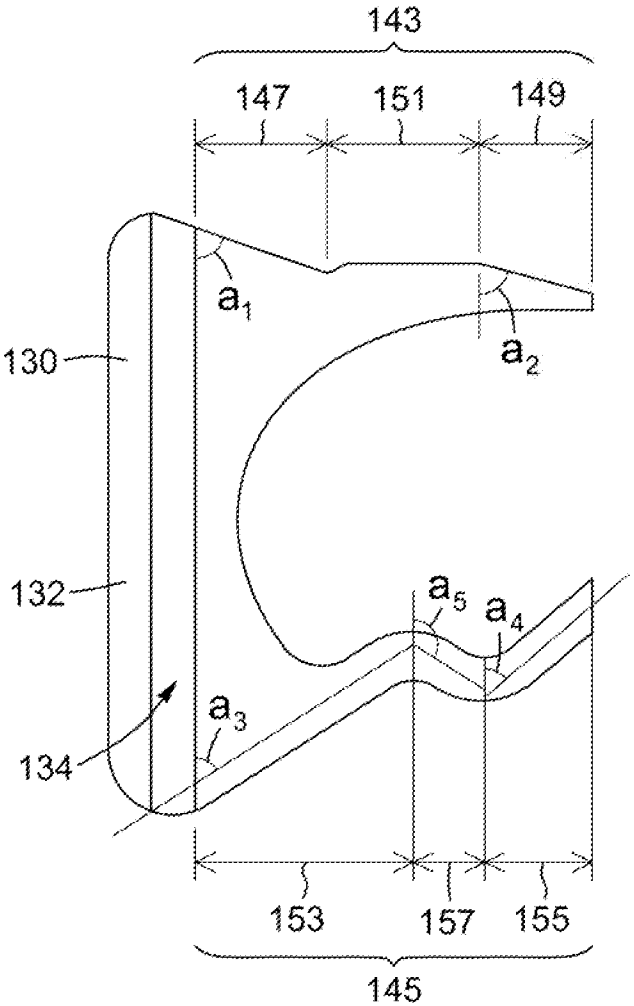
FIG. 25 is a side elevational view of the first connector of FIG. 4.

As represented in FIG. 25, the upper projection 143 comprises a proximal end 147 connected to the mounting plate 132 and an opposed distal end 149. The upper projection 143 might further comprise an intermediate portion 151 extending between the proximal and distal ends.

In the embodiment shown, the proximal end 147 defines an inclination angle a1 with respect to vertical when the wall connecting assembly 100 is in use (i.e. in the assembled configuration). In some embodiments, the inclination angle a1 of the proximal end 147 is acute. In some embodiments, the inclination angle a1 of the proximal end 147 is smaller than about 90°. In some other embodiments, the inclination angle a1 of the proximal end 147 is smaller than about 85°. In some other embodiments, the inclination angle a1 of the proximal end 147 is smaller than about 80°. In some other embodiments, the inclination angle a1 of the proximal end 147 is smaller than about 75°. In some other embodiments, the inclination angle a1 of the proximal end 147 is between about 60° and about 90°. In some other embodiments, the inclination angle a1 of the proximal end 147 is between about 70° and about 85°.

In the embodiment shown, the distal end 149 defines an inclination angle a2 with respect to vertical when the wall connecting assembly 100 is in use (i.e. in the assembled configuration). In some embodiments, the inclination angle a2 of the distal end 149 is acute. In some embodiments, the inclination angle a2 of the distal end 149 is smaller than about 90°. In some other embodiments, the inclination angle a2 of the distal end 149 is smaller than about 85°. In some other embodiments, the inclination angle a2 of the distal end 149 is smaller than about 80°. In some other embodiments, the inclination angle a2 of the distal end 149 is smaller than about 75°. In some other embodiments, the inclination angle a2 of the distal end 149 is between about 60° and about 90°. In some other embodiments, the inclination angle a2 of the distal end 149 is between about 70° and about 85°.

In the embodiment shown, the intermediate portion 151 extends substantially horizontally between the proximal end 147 and the distal end 149. As represented in FIG. 25, the intermediate portion 151 comprises a proximal end portion connected to the proximal end 147, the proximal end portion of the intermediate portion defining an obtuse inclination angle with respect to vertical when the wall connecting assembly 100 is in the assembled configuration. It could also be conceived an upper projection 143 having an intermediate portion defining an inclination angle (for instance an obtuse angle) along its entirety with respect to vertical when the wall connecting assembly 100 is in use (i.e. in the assembled configuration).

As represented in FIG. 25, the lower projection 145 comprises a proximal end 153 connected to the mounting plate 132 and an opposed distal end 155. The lower projection 145 might further comprise an intermediate portion 157 extending between the proximal and distal ends 153, 155.

In the embodiment shown, the proximal end 153 defines an inclination angle a3 with respect to vertical when the wall connecting assembly 100 is in use (i.e. in the assembled configuration). In some embodiments, the inclination angle a3 of the proximal end 153 is acute. In some embodiments, the inclination angle a3 of the proximal end 153 is smaller than about 90°. In some other embodiments, the inclination angle a3 of the proximal end 153 is smaller than about 85°. In some other embodiments, the inclination angle a3 of the proximal end 153 is smaller than about 80°. In some other embodiments, the inclination angle a3 of the proximal end 153 is smaller than about 75°. In some other embodiments, the inclination angle a3 of the proximal end 153 is between about 60° and about 90°. In some other embodiments, the inclination angle a3 of the proximal end 153 is between about 70° and about 85°.

In the embodiment shown, the distal end 155 defines an inclination angle a4 with respect to vertical when the wall connecting assembly 100 is in use (i.e. in the assembled configuration). In some embodiments, the inclination angle a4 of the distal end 155 is acute. In some embodiments, the inclination angle a4 of the distal end 155 is smaller than about 90°. In some other embodiments, the inclination angle a4 of the distal end 155 is smaller than about 85°. In some other embodiments, the inclination angle a4 of the distal end 155 is smaller than about 80°. In some other embodiments, the inclination angle a4 of the distal end 155 is smaller than about 75°. In some other embodiments, the inclination angle a4 of the distal end 155 is between about 60° and about 90°. In some other embodiments, the inclination angle a4 of the distal end 155 is between about 70° and about 85°.

In the embodiment shown, the intermediate portion 157 defines an inclination angle a5 with respect to vertical when the wall connecting assembly 100 is in use (i.e. in the assembled configuration). In some embodiments, the inclination angle a5 of the intermediate portion 157 is obtuse. In some embodiments, the inclination angle a5 of the intermediate portion 157 is greater than about 90°. In some other embodiments, the inclination angle a5 of the intermediate portion 157 is greater than about 95°. In some other embodiments, the inclination angle a5 of the intermediate portion 157 is greater than about 100°. In some other embodiments, the inclination angle a5 of the intermediate portion 157 is greater than about 110°.

In some embodiments, the inclination angle a1 of the proximal end 147 of the upper tongue 143 is greater than or equal to the inclination angle a3 of the proximal end 153 of the lower tongue 145.

In the embodiment shown, at least one of the upper and lower projections 143, 145 (both of them, in the embodiment shown) comprises a longitudinal blocker (i.e. extending substantially along a length of the first connector 130) configured to cooperate with a corresponding longitudinal blocker formed in the second engaging portion 162 of the second connector 160, as detailed below.

In the embodiment shown, longitudinal blockers are formed at a junction of adjacent portions of the upper and lower projections 143, 145, at an outer face thereof (i.e. at a face facing wall portions of the second connector 162). For instance and without being limitative, the upper projection 143 comprises a first longitudinal blocker formed by a junction between the proximal end 147 and the intermediate portion 151, and a second longitudinal blocker formed by a junction between the intermediate portion 151 and the distal end 149. For instance, the lower projection 145 comprises a first longitudinal blocker formed by a junction between the proximal end 153 and the intermediate portion 157, and a second longitudinal blocker formed by a junction between the intermediate portion 157 and the distal end 155. As represented in FIG. 25, the junctions between the different portions of the upper and lower projections 143, 145 at the outer face thereof can, for instance and without being limitative, be substantially sharp or rounded.

Depending on the profile of the considered sections of the upper and lower projections 143, 145, the longitudinal blocker can either be formed by a protrusion protruding from an inner face of the corresponding upper and lower projections 143, 145, or by a longitudinal groove formed in the inner face of the corresponding upper and lower projections 143, 145.

In the embodiment shown, the first connector 130 has a substantially vertical plane of symmetry.

In the embodiment shown, the upper and lower projections 143, 145 have different profiles. It could be conceived a first engaging portion 140 of a first connector 130 having upper and lower projections of substantially similar profiles (i.e. a first engaging portion 140 having a substantially horizontal plane of symmetry). It could also be conceived different profiles of the upper and lower projections 143, 145 (as detailed below with reference to FIGS. 11 to 24). For instance, the profiles of the upper and lower projections 143, 145 could be inverted with regards to the above-described embodiment.

It is appreciated that the shape and the configuration of the first connector 130, for instance, the shape, the configuration, the number, and the location of the left and right mounting grooves 134, 134' with regards to the mounting plate 132, and the shape, the configuration and the location of the upper and lower projections 143, 145 can vary from the embodiment shown.

Second Connector

As represented in FIGS. 4 to 7, the second engaging portion 162 of the second connector 160 comprises an upper wall portion 164 and a lower wall portion 166 for receiving the upper and lower projections 143, 145 of the first engaging portion 140 therebetween. In other words, the upper and lower wall portions 164, 166 define a connector-receiving cavity 168 in-between, the connector-receiving cavity 168 being shaped and dimensioned to receive and maintain the first engaging portion 140.

In the embodiment shown, the upper and lower wall portions 164, 166 both extend in a substantially horizontal direction when the wall connecting assembly 100 is in use (i.e. when configured in the assembled configuration).

Figure 26:
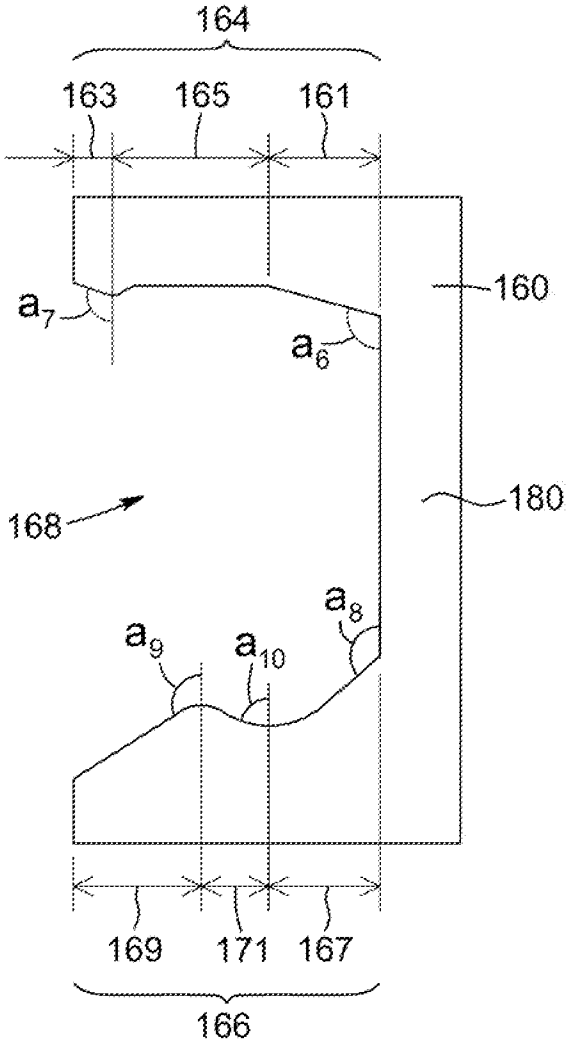
FIG. 26 is a side elevational view of the second connector of FIG. 4.

As represented in FIG. 26, the upper wall portion 164 comprises a proximal end 161 connected to a back wall 180 of the second connector 160 partially delimiting the connector-receiving cavity 168 and an opposed distal end 163. The upper wall portion 164 might further comprise an intermediate portion 165 extending between the proximal and distal ends.

In the embodiment shown, the proximal end 161 defines an inclination angle a6 with respect to vertical when the wall connecting assembly 100 is in the assembled configuration. The inclination angle a6 of the proximal end 161 supplements the inclination angle a2 defined by the distal end 149 of the upper projection 143. In some embodiments, the inclination angle a6 of the proximal end 161 is thus obtuse.

In the embodiment shown, the distal end 163 defines an inclination angle a7 with respect to vertical when the wall connecting assembly 100 is in use (i.e. in the assembled configuration). The inclination angle a7 of the distal end 163 supplements the inclination angle a1 of the proximal end 147 of the upper projection 143. In some embodiments, the inclination angle a7 of the distal end 163 is thus obtuse.

In the embodiment shown, the intermediate portion 165 extends substantially horizontally between the proximal end 161 and the distal end 163.

As represented in FIG. 26, the lower wall portion 166 comprises a proximal end 167 connected to the back wall 180 of the second connector 160 and an opposed distal end 169. The lower wall portion 166 might further comprise an intermediate portion 171 extending between the proximal and distal ends 167, 169.

In the embodiment shown, the proximal end 167 defines an inclination angle a8 with respect to vertical when the wall connecting assembly 100 is in use (i.e. in the assembled configuration). The inclination angle a8 of the proximal end 167 supplements the inclination angle a4 defined by the distal end 155 of the lower projection 145. In some embodiments, the inclination angle a8 of the proximal end 167 is thus obtuse.

In the embodiment shown, the distal end 169 defines an inclination angle a9 with respect to vertical when the wall connecting assembly 100 is in use (i.e. in the assembled configuration). The inclination angle a9 of the distal end 169 supplements the inclination angle a3 of the proximal end 153 of the lower projection 145. In some embodiments, the inclination angle a9 of the distal end 169 is thus obtuse.

In the embodiment shown, the intermediate portion 171 defines an inclination angle a10 with respect to vertical when the wall connecting assembly 100 is in use (i.e. in the assembled configuration). The inclination angle a10 of the intermediate portion 171 of the lower wall portion 166 supplements the inclination angle a5 of the intermediate portion 157 of the lower projection 145. In some embodiments, the inclination angle a10 of the intermediate portion 171 is thus acute.

In the embodiment shown, at least one of the upper and lower wall portions 164, 166 (both of them, in the embodiment shown) comprises a longitudinal blocker (i.e. extending substantially along a length of the second connector 160) configured to cooperate with a corresponding longitudinal blocker formed in the first engaging portion 140 of the first connector 130.

In the embodiment shown, longitudinal blockers are formed at junctions of adjacent portions of the upper and lower wall portions 164, 166, at an inner face thereof (i.e. considered with regards to the connector receiving cavity 168). For instance and without being limitative, the upper wall portion 164 comprises a first longitudinal blocker formed by a junction between the proximal end 161 and the intermediate portion 165, and a second longitudinal blocker formed by a junction between the intermediate portion 165 and the distal end 163. For instance, the lower wall portion 166 comprises a first longitudinal blocker formed by a junction between the proximal end 167 and the intermediate portion 171, and a second longitudinal blocker formed by a junction between the intermediate portion 171 and the distal end 169. As represented in FIG. 26, the junctions between the different portions of the upper and lower wall portions 164, 166 at the inner face of the upper and lower wall portions 164, 166 can, for instance and without being limitative, be substantially sharp or rounded.

Similarly to the first engaging portion 140, depending on the profile of the considered sections of the upper and lower wall portions 164, 166, the longitudinal blocker can either be formed by a protrusion protruding from an inner face of the corresponding upper and lower wall portions 164, 166, or by a longitudinal groove formed in the inner face of the corresponding upper and lower wall portions 164, 166.

In the embodiment shown, the second connector 160 has a substantially vertical plane of symmetry.

In the embodiment shown, the upper and lower wall portions 164, 166 have different profiles. It could be conceived a second engaging portion 162 of a second connector 160 having upper and lower wall portions of substantially similar profiles (i.e. a second connector 162 having a substantially horizontal plane of symmetry). It could also be conceived different profiles of the upper and lower wall portions 164, 166. For instance, the profiles of the upper and lower wall portions 164, 166 could be inverted with regards to the above-described embodiment.

It is appreciated that the shape and the configuration of the second connector 160, for instance, the shape, the configuration and the location of the upper and lower wall portions 164, 166 can vary from the embodiment shown.

Figure 3:
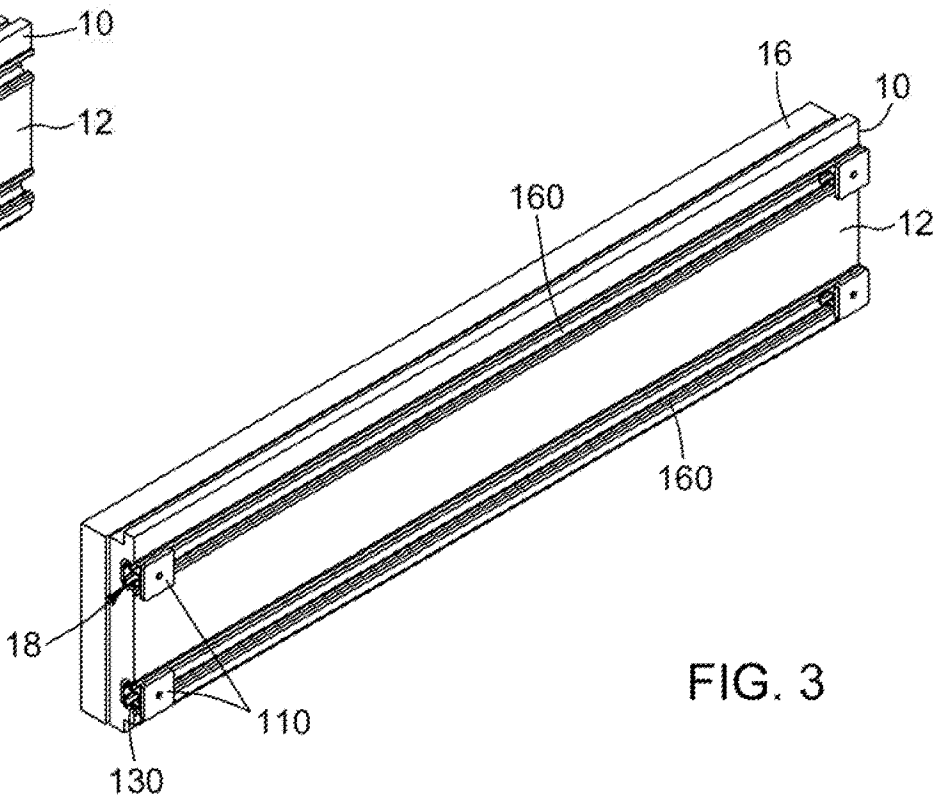
FIG. 3 is a perspective view of the inner face of the wall panel of FIG. 2, a plurality of first connectors and receiving plates being mounted to a plurality of second connectors.
Figure 2:
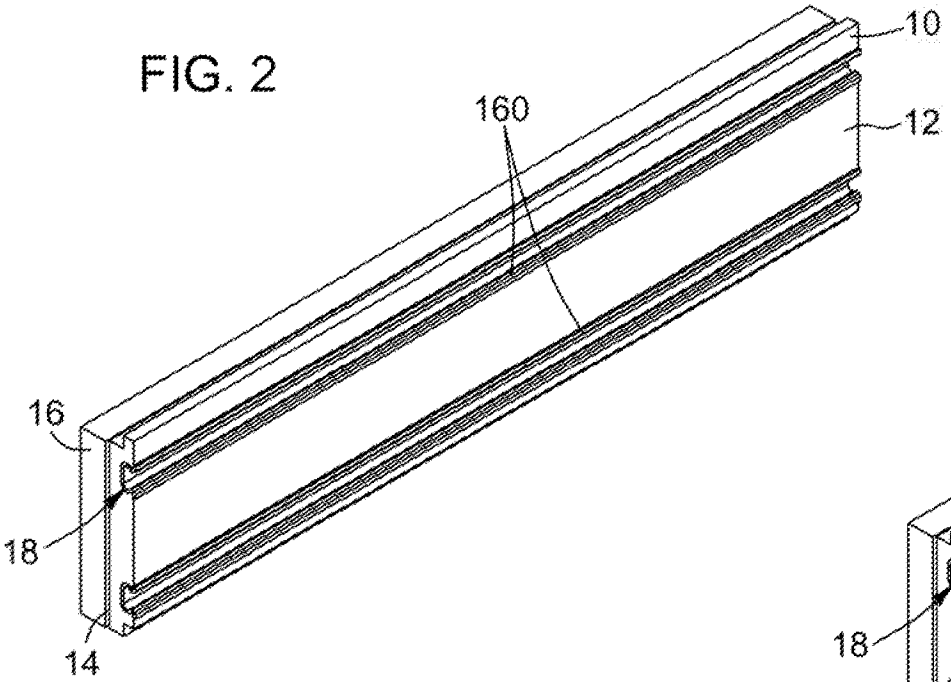
FIG. 2 is a perspective view of the inner face of the wall panel of FIG. 1.

In the embodiment shown in FIGS. 4 to 7, the second connector 160 is distinct from the wall panel 10 and is securable to the face 12 thereof by any adapted mechanical fastener. For instance and without being limitative, as represented in FIGS. 2 and 3, a cavity 18 could be formed in the inner face 12 of the wall panel 10 that is shaped and dimensioned to receive at least partially the second connector 160. Moreover, as represented in FIGS. 4 to 7, the second connector 160 might have a length corresponding substantially to a length of the receiving plate 110 and the first connector 130. In other embodiments, as represented in FIGS. 2 and 3, the second connector 160 might extend along all or part of a length of the wall panel 10 and cooperate with one or more first connectors 130 and receiving plates 110 to connect the wall panel 10 to the wall structure 20.

In some other embodiments, the second connector 160 is formed integral with the wall panel 10. In other words, the connector receiving cavity 168 of the second connector 160 is delimited by a body of the wall panel 10 extending between its faces 12, 14.

It is thus understood that the wall panel can be connected via a plurality of second connectors—either formed integral with the inner face of the wall panel, or being at least partially receiving in a cavity defined in the inner face of the wall panel—each of the plurality of second connectors having a second engaging portion adapted to register with the first engaging portion of a plurality of first connectors. The wall panel can also be connected via a plurality of first connectors having first engaging portions engageable with a second engaging portion of a single second connector extending along all or part of a length of the wall panel, the second connector being either formed integral with the inner face of the wall panel, or being at least partially receiving in a cavity defined in the inner face of the wall panel.

Method for Covering a Wall Structure with a Wall Panel

There is also provided a method for covering a wall structure 20 with a wall panel 10. The method comprises mounting a receiving plate 110 to a face 24 of the wall structure 20, the receiving plate 110 defining a receiving space 112 and comprising a lower projection 114. The method further comprises mounting a mounting plate 132 of a first connector 130 within the receiving space 112 of the receiving plate 110, the first connector 130 further comprising a first engaging portion 140 extending from the mounting plate 132; and connecting to the first engaging portion 140 a second engaging portion 162 of a second connector 160 being part of or being mounted to an inner face 12 of the wall panel 10. In other words, there is provided a method for covering the face 24 of the wall structure 20, the method comprising mounting the receiving plate 110 to the face 24 of the wall structure 20, the receiving plate 110 defining a receiving space 112 and comprising a lower projection 114 extending from a lower portion of the receiving plate 110; providing a first connector 130 comprising a mounting plate 132 adapted to be at least partially slidably mounted within the receiving space 112 and a first engaging portion 140 extending from the mounting plate 132; mounting the first connector 130 to the receiving plate 110 by sliding the mounting plate 132 within the receiving space 112 and then by abutting the mounting plate 132 against the lower projection 114 such that the mounting plate 132 is within the receiving space 112 of the receiving plate 110; providing the wall panel 10 having a second connector 160 being part of or being mounted to the inner face 12 of the wall panel 10, the second connector 160 defining a second engaging portion 162 adapted to register with the first engaging portion of the first connector; and engaging together the first and second connectors such that the wall panel is at least partially connected to the wall structure.

In some embodiments, the method further comprises mounting the first connector 130 within the receiving space 112 of the receiving plate 110 along a substantially vertical direction.

In some embodiments, the method further comprises vertically adjusting the relative positions of the wall panel 10 and the wall structure 20 by displacing the first connector 130 (and more particularly the mounting plate 132 thereof) within the receiving space 112.

The wall panel 10 can thus be easily and strongly connected to the wall structure 20. In particular, the flexible connection to the mounting plate 132 of the upper and lower projections 143, 145 of the first engaging portion 140 allows an easy connection of the first and second connectors 130, 160 when the second connector 160 is directed towards the first connector along a connection direction substantially horizontal.

Moreover, the mounting of the mounting plate 132 within the receiving space 112 allows some vertical adjustment of the position of the first connector 130 with regards to the receiving plate 110. The lower projection 114 of the receiving plate 110 is configured to limit the vertical adjustment of the position of the first connector 130 with regards to the receiving plate 110. Moreover, in the embodiment in which the lower projection 114 comprise a dampening element 119, as described above, the dampening element 119 is configured to ensure a dampened contact between the mounting plate of the first connector 130 and the lower projection 114 of the receiving plate 110.

The cooperation of the first and second connectors 130, 160 limits the risk that the wall panel 10 would be accidentally disconnected from the wall structure 20. In the embodiment shown, the longitudinal blockers of the first and second connectors 140, 162 are shaped and dimensioned to maintain the connection of the first connector 130 and the second connector 160, by providing a resistance opposed to a disconnection of the first and second connectors 130, 160 upon a traction directed along a substantially horizontal direction opposed to the connection direction. For instance, the wall connecting assembly is configured for the wall panel and its connection to the wall structure to comply with the provisions of the international residential code, and more particularly to its chapter 7 (for instance sections 703.1.2, 703.3 (1), 703.3.2, 703.3.3, 703.3 (1), 703.8, 703.8 (1), 703.8 (2) and 703.12 of 2018 International Residential Code), relative to wall covering, and to its chapter 3 (for instance sections 301.2 (2), 301.2 (3) and 301.2 (5) A of 2018 International Residential Code), relative to building planning.

Moreover, as mentioned above, the first connector 130 and the second connector 160 are connectable to each other upon displacement of the second connector 160 towards the first connector 130 along a substantially horizontal direction, substantially perpendicular to the plane defined by the mounting plate 132 of the first connector 130 (i.e. substantially perpendicular to the back-wall portion 116 of the receiving plate 110, i.e. substantially perpendicular to the plane of the portion of the face 24 of the wall structure 20 to which the receiving plate 110 is mounted). In the embodiments in which the first and second connectors 130, 160 present a substantially vertical plane of symmetry, it is understood that the first and second connectors 130, 160 are shaped and dimensioned to allow some horizontal adjustment of the position of the second connector 160 with regard to the first connector 130. The extend of this horizontal adjustment is particularly significant when the second connector 160 has a length greater than a length of the first connector 130 (considered along a substantially horizontal direction), for instance when the second connector 160 extends along all or part of a length of the wall panel 10, as represented in FIGS. 2 and 3.

In some embodiments, the method further comprises providing a connecting panel 170 comprising the receiving plate 110 and securing the connecting panel 170 to the face 24 of the wall structure 20.

In some embodiments, the connecting panel 170 comprises a plurality of receiving plates 110 and the method further comprises mounting a mounting plate 132 of each of a plurality of first connector assemblies 130 within the receiving space 112 of a corresponding receiving plate 110; and connecting to the first connector 140 of each of said plurality of first connector assemblies 130 the second connector 162 of each of a plurality of second connector assemblies 160. The method thus comprises providing the connecting panel 170 comprising first and second receiving plates 110; and mounting the connecting panel 170 to the face of the wall structure such that the connecting panel is arranged between the wall structure and the wall panel when the wall panel is connected to the wall structure.

For instance and without being limitative, the connection of the second engaging portions 162 to the first engaging portions 140 is carried out sequentially.

The use of the connecting panel 170 comprising a plurality of receiving plates 110 eases the mounting of the wall panel 10 to the wall structure 20: once the connecting panel 170 is secured at a pre-determined position of the wall structure, it is ensured that all the receiving plates 110 of the connecting panel 170 are also adequately secured to the wall structure 20. Moreover, the securing of additional connecting panels 170 to the wall structure 20 is also eased once a first connecting panel 170 has been secured: for instance, the user can abut an additional connecting panel 170 against a side portion of the first secured connecting panel 170 to adequately secure the additional connecting panel 170 to the wall structure 20.

In some embodiments, the method further comprises forming a cavity 18 (or connector-mounting cavity) in the inner face 12 of the wall panel 10; and introducing at least partially the second connector 160 into the cavity 18.

In some embodiments, once the wall panel 10 is mounted to the wall structure (i.e. when the wall connecting assembly 100 is in use, i.e. in the assembled configuration), the inner face 12 of the wall panel 10 is substantially flush with the face 24 of the wall structure 20.

In some other embodiments, once the wall panel 10 is mounted to the wall structure (i.e. when the wall connecting assembly 100 is in use, i.e. in the assembled configuration), the inner face 12 of the wall panel 10 is horizontally spaced apart from the face 24 of the wall structure 20.

Other Embodiments of the Wall Connecting Assembly

As mentioned above, the shape and the configuration of the wall connecting assembly 100 is not limited to the embodiment described above. In particular, the shape and the configuration of the first connector and the second connector can vary from the embodiment described above.

Figure 11:
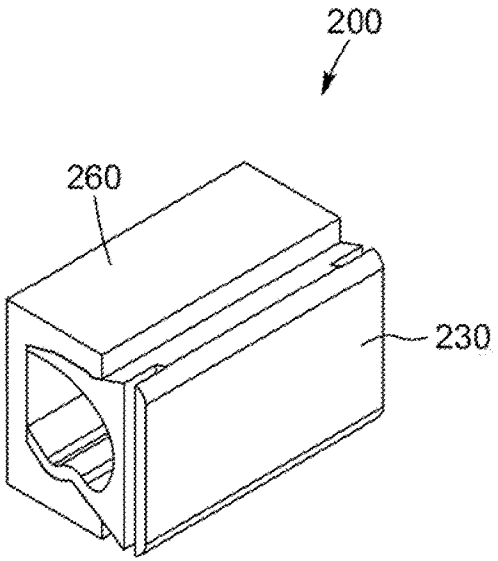
FIG. 11 is a rear perspective view of another embodiment of a wall connecting assembly comprising a first connector and a second connector in the assembled configuration.
Figure 13:
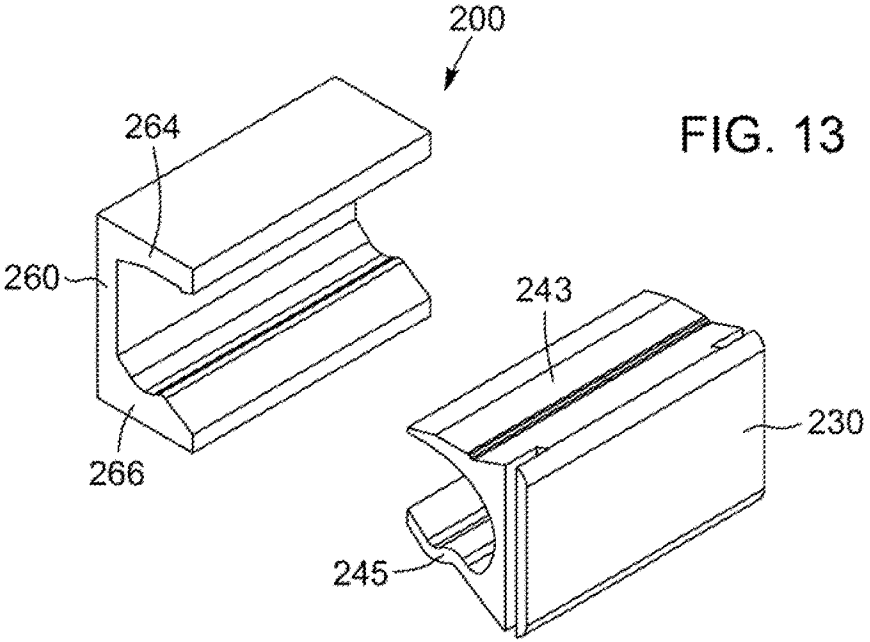
FIG. 13 is an exploded view of the wall connecting assembly of FIG. 11.
Figure 12:
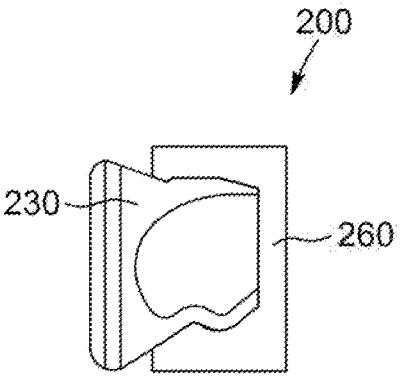
FIG. 12 is a side elevational view of the wall connecting assembly of FIG. 11.

FIGS. 11 to 13 represent another embodiment of a wall connecting assembly 200 comprising a first connector 230 and a second connector 260. Similarly to the embodiment described above, the first connector 230 comprises upper and lower projections 243, 245 configured to be received and maintained between upper and lower wall portions 264, 266 of the second connector 260. The embodiment represented in FIGS. 11 to 13 differs from the embodiment represented in FIGS. 4 to 7, 25 and 26 by the shape and the inclination angles with respect to vertical of the proximal end, the distal end and the intermediate portion of the upper and lower projections 243, 245 and the upper and lower wall portions 264, 266 when the wall connecting assembly 200 is in the assembled configuration.

Figure 14:
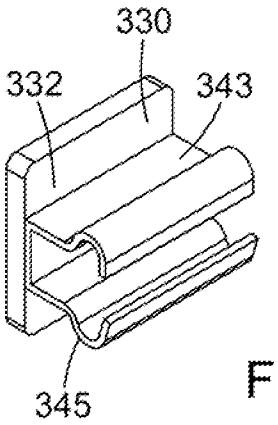
FIGS. 14 and 15 are perspective views respectively of a first connector and a second connector of a wall connecting assembly in accordance with another embodiment.
Figure 15:
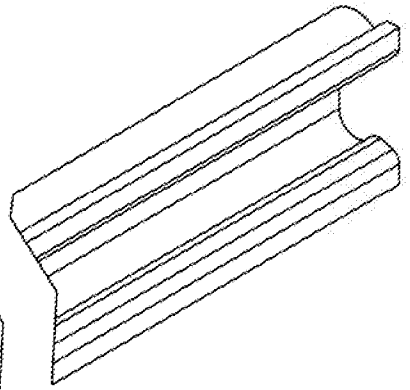
Figure 16:
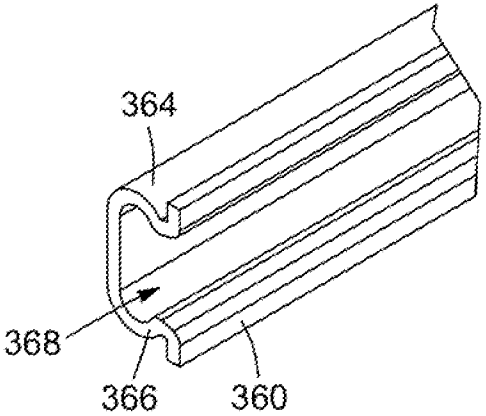
FIG. 16 is a side elevational view of the first and second connectors of FIGS. 14 and 15 in the assembled configuration.
Figure 16:
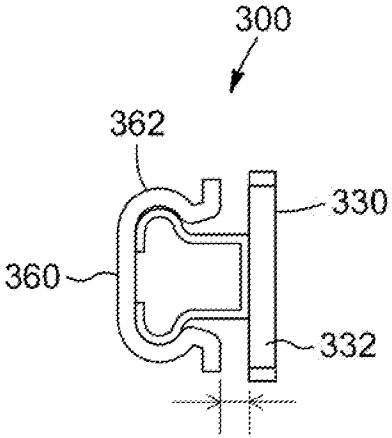

FIGS. 14 to 16 represent another embodiment of a wall connecting assembly 300 comprising a first connector 330 and a second connector 360. Similarly to the embodiments described above, the first connector 330 comprises upper and lower projections 343, 345 configured to be received and maintained between upper and lower wall portions 364, 366 of the second connector 360. In the embodiment shown, the upper and lower projections 343, 345 both comprise a proximal end extending substantially horizontally when the wall connecting assembly 300 is configured in the assembled configuration, and a distal end having a C-shaped cross-section. The upper and lower wall portions 364, 366 also both comprise a proximal end having a C-shaped cross-section and a distal end protruding substantially vertically, when the wall connecting assembly 300 is configured in the assembled configuration, outwardly from the connector-receiving cavity 368. The distal ends of the upper and lower projections 343, 345 thus form longitudinal blockers configured to cooperate with the proximal ends of the upper and lower wall portions 364, 366. As represented in FIG. 16, when the wall connecting assembly 300 is configured in the assembled configuration, the distal end of the second engaging portion 362 (formed by the distal ends of the upper and lower wall portions 364, 366) is horizontally spaced apart—as represented in FIG. 16—from the mounting plate 332 of the first connector 330.

Figure 19:
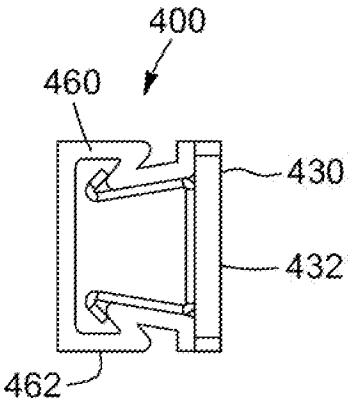
FIG. 19 is a side elevational view of the first and second connectors of FIGS. 17 and 18 in the assembled configuration.
Figure 18:
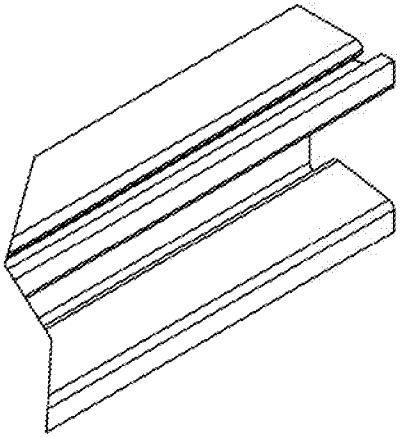
FIGS. 17 and 18 are perspective views respectively of a first connector and a second connector of a wall connecting assembly in accordance with another embodiment.
Figure 17:
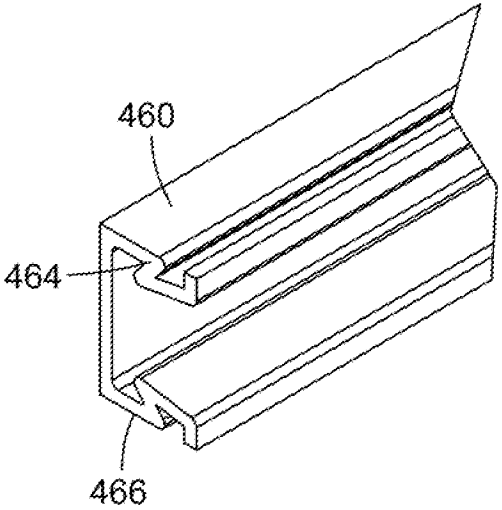
Figure 17:
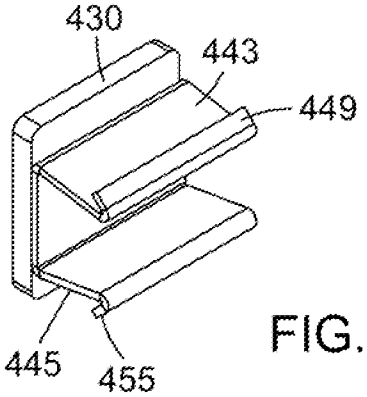

FIGS. 17 to 19 represent another embodiment of a wall connecting assembly 400 comprising a first connector 430 and a second connector 460. Similarly to the embodiments described above, the first connector 430 comprises upper and lower projections 443, 445 configured to be received and maintained between upper and lower wall portions 464, 466 of the second connector 460. In the embodiment shown, the upper and lower projections 443, 445 both comprise a body defining an acute inclination angle with respect to vertical when the wall connecting assembly 400 is configured in the assembled configuration, and a distal end 449, 455 forming an outwardly protruding hooking portion. The upper and lower wall portions 464, 466 also both comprise a distal end defining an obtuse inclination angle with respect to vertical when the wall connecting assembly 400 is configured in the assembled configuration and a hook receiving groove formed at a proximal end thereof, the hook receiving grooves being shaped and dimensioned, as represented in FIG. 19, to receive and maintain the distal ends 449, 455 of the upper and lower projections 443, 445. The distal ends 449, 455 of the upper and lower projections 443, 445 thus form longitudinal blockers configured to cooperate with the hook receiving grooves formed at the proximal ends of the upper and lower wall portions 464, 466. As represented in FIG. 19, when the wall connecting assembly 400 is configured in the assembled configuration, the distal end of the second engaging portion 462 (formed by the distal ends of the upper and lower wall portions 464, 466) substantially abuttingly engages the mounting plate 432 of the first connector 430.

Figure 20:
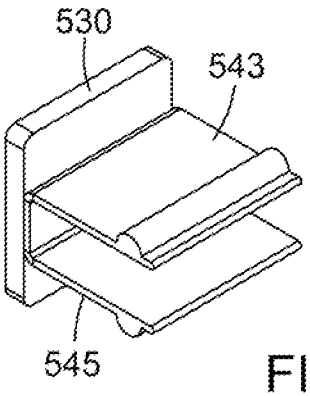
FIGS. 20 and 21 are perspective views respectively of a first connector and a second connector of a wall connecting assembly in accordance with another embodiment.
Figure 21:
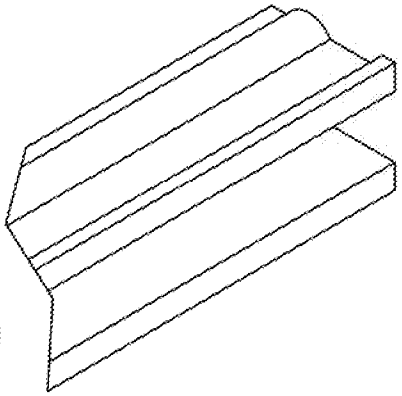
Figure 22:
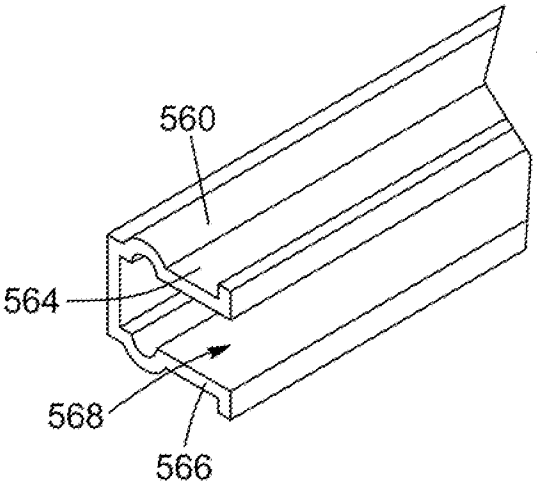
FIG. 22 is a side elevational view of the first and second connectors of FIGS. 20 and 21 in the assembled configuration.
Figure 22:
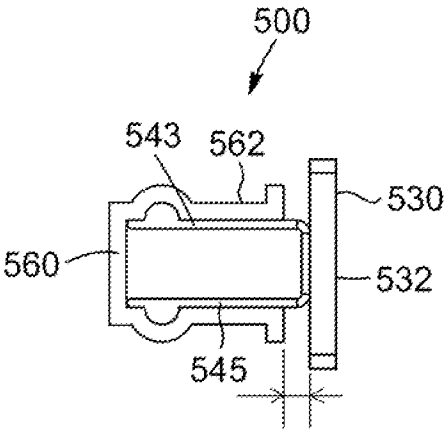

FIGS. 20 to 22 represent another embodiment of a wall connecting assembly 500 comprising a first connector 530 and a second connector 560. In the embodiment shown, the upper and lower projections 543, 545 both comprise a proximal end extending substantially horizontally when the wall connecting assembly 500 is configured in the assembled configuration, and a distal end having a C-shaped cross-section. The upper and lower wall portions 564, 566 also both comprise a proximal end having a C-shaped cross-section, an intermediate portion extending substantially horizontally when the wall connecting assembly 500 is configured in the assembled configuration, and a distal end protruding substantially vertically, when the wall connecting assembly 500 is configured in the assembled configuration, outwardly from the connector-receiving cavity 568. The distal ends of the upper and lower projections 543, 545 thus form longitudinal blockers configured to cooperate with the proximal ends of the upper and lower wall portions 564, 566. As represented in FIG. 22, when the wall connecting assembly 500 is configured in the assembled configuration, the distal end of the second engaging portion 562 (formed by the distal ends of the upper and lower wall portions 564, 566) is horizontally spaced apart from the mounting plate 532 of the first connector 530, as represented in FIG. 22.

Figure 24:
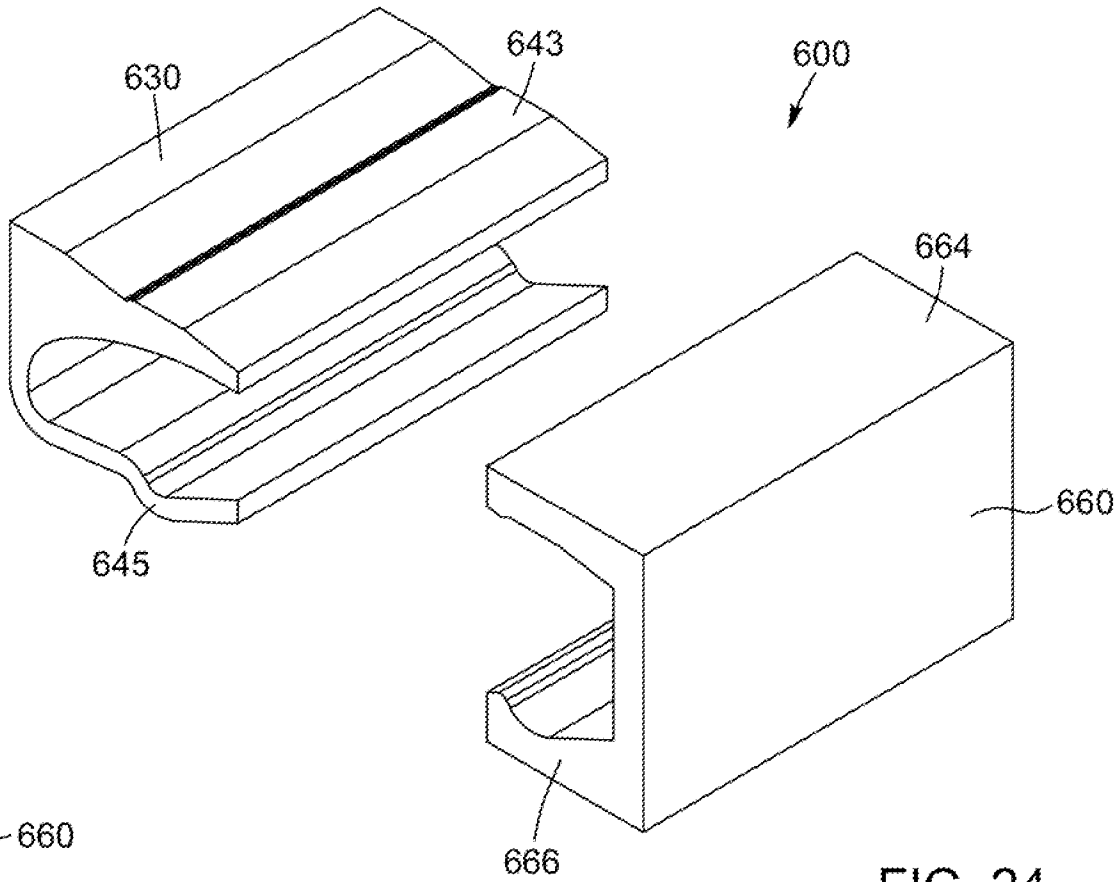
FIG. 24 is an exploded view of the wall connecting assembly of FIG. 23.
Figure 23:
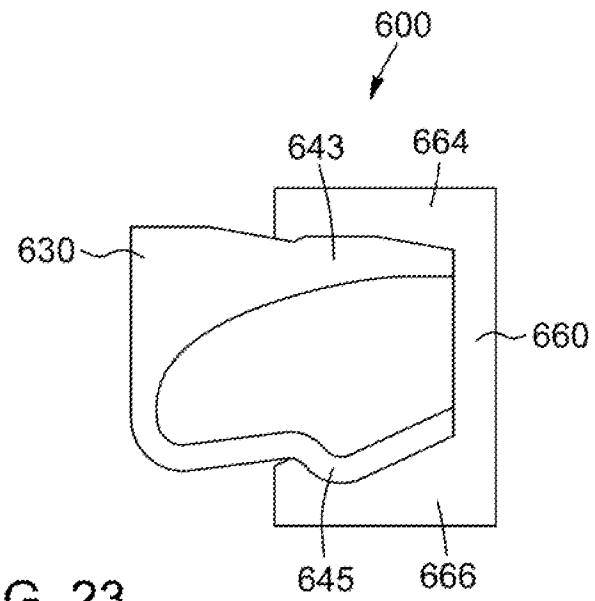
FIG. 23 is a side elevational view of a first connector and a second connector of a wall connecting assembly in accordance with another embodiment, the first and second connectors being configured in the assembled configuration.

FIGS. 23 and 24 represent another embodiment of a wall connecting assembly 600 comprising a first connector 630 and a second connector 660. The embodiment represented in FIGS. 23 and 24 differs from the embodiment represented in FIGS. 4 to 7, 25 and 26 by the shape and the inclination angles with respect to vertical of the proximal end, the distal end and the intermediate portion of the upper and lower projections 643, 645 and the upper and lower wall portions 664, 666 when the wall connecting assembly 600 is in the assembled configuration. Moreover, the upper and lower wall portions 664, 666 comprise a longitudinal blocker proximate the distal end thereof (for instance formed at the distal end thereof) that is configured to cooperate with longitudinal blockers formed on the upper and lower projections 643, 645 at junctions between intermediate portions and proximal ends thereof, as represented in FIG. 23.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited by the scope of the appended claims.

The invention claimed is:

1. A wall connecting assembly for mounting a wall panel to a wall structure, the wall panel having an inner face and the wall structure having a face to be at least partially covered by the wall panel, the wall connecting assembly comprising:

a receiving plate to be mounted to the face of the wall structure, the receiving plate defining a receiving space and comprising a lower projection extending from a lower portion of the receiving plate;

a first connector comprising a mounting plate to be at least partially mounted within the receiving space and a first engaging portion extending from the mounting plate toward the inner face of the wall panel when the wall structure is at least partially covered by the wall panel, the mounting plate extending along a substantial vertical direction from an upper edge to a lower edge; and a second connector being part of or being mounted to the inner face of the wall panel and defining a second engaging portion to register with the first engaging portion of the first connector wherein, in use, (i) the receiving plate is mounted to the face of the wall structure, (ii) the mounting plate is slidably mounted along the substantial vertical direction toward the lower portion of the receiving plate such that the lower edge of the mounting plate contacts the lower projection for connecting the first connector to the receiving plate and thereby mounting the first connector to the wall structure, and (iii) the second engaging portion registers with the first engaging portion of the first connector such that the first and second engaging portions engage together for at least partially connecting the wall panel to the wall structure.

2. The wall connecting assembly according to claim 1, wherein the receiving plate comprises a back-wall portion and left and right vertical protections spaced-apart from each other and extending outwardly from the back-wall portion and toward each other, the left and right vertical projections and the back-wall portion partially delimiting together the receiving space.

3. The wall connecting assembly according to claim 2, wherein the mounting plate of the first connector comprises left and right mounting grooves each extending along the substantial vertical direction from the upper edge to the lower edge of the mounting plate for slidably receiving the respective left and right vertical projections.

4. The wall connecting assembly according to claim 1, wherein the receiving plate comprises a dampening element arranged between the lower edge of the mounting plate and an upper face of the lower projection and wherein the lower edge of the mounting plate contacts the dampening element.

5. The wall connecting assembly according to claim 1, wherein the first engaging portion of the first connector is of a male type engaging portion and the second engaging portion of the second connector is of a female type engaging portion.

6. The wall connecting assembly according to claim 5, wherein the mounting plate comprises an inner face facing the receiving plate when the mounting plate is within the receiving space of the receiving plate and an opposed outer face and wherein the first engaging portion comprising upper and lower projections extending from the outer face of the mounting plate.

7. The wall connecting assembly according to claim 6, wherein one of the upper and lower projections comprises a proximal end proximate the mounting plate and an opposed distal end and wherein one of the proximal and distal ends defines an acute inclination angle with respect to a vertical axis when the wall panel is at least partially connected to the wall structure.

8. The wall connecting assembly according to claim 6, wherein one of the upper and lower projections is at least partially made of a resilient material such that, when the first and second engaging portions engage together, said one of the upper and lower projections is biased toward the second engaging portion.

9. The wall connecting assembly according to claim 6, wherein the second connector comprises upper and lower wall portions for receiving the upper and lower projections therebetween.

10. The wall connecting assembly according to claim 9, wherein the upper and lower projections are biased toward the respective upper and lower wall portions when the first and second engaging portions engage together.

11. The wall connecting assembly according to claim 9, wherein the upper and lower wall portions comprise an inner face delimiting at least partially a connector receiving cavity and wherein at least one of the upper and lower projections comprises a longitudinal blocker configured to cooperate with a corresponding longitudinal blocker formed in the inner face of the corresponding one of the upper and lower wall portions.

12. The wall connecting assembly according to claim 1, wherein the second connector is formed integral with the inner face of the wall panel.

13. The wall connecting assembly according to claim 1, wherein the inner face of the wall panel defines a cavity and wherein the second connector is at least partially received in the cavity.

14. A wall system, comprising:

a wall structure having a face;

a wall panel for at least partially covering the face of the wall structure, the wall panel having an inner face;

a plurality of wall connecting assemblies, each wall connecting assembly comprising: (i) a receiving plate to be mounted to the face of the wall structure, each receiving plate defining a receiving space and comprising a lower projection extending from a lower portion of the receiving plate, (ii) a first connector comprising a mounting plate to be at least partially mounted within the receiving space of the receiving plate and a first engaging portion extending from the mounting plate toward the inner face of the wall panel when the wall structure is at least partially covered by the wall panel, the mounting plate extending along a substantial vertical direction from an upper edge to a lower edge, and (iii) a second connector being part of or being mounted to the inner face of the wall panel and defining a second engaging portion to register with the first engaging portion, wherein, in use, (i) the receiving plate is mounted to the face of the wall structure, (ii) the mounting plate is slidably mounted along the substantial vertical direction toward the lower portion of the receiving plate such that the lower edge of the mounting plate contacts the lower projection for connecting the first connector to the receiving plate and thereby mounting the first connector to the wall structure, and (iii) the second engaging portion registers with the first engaging portion of the first connector such that the first and second engaging portions of each wall connecting assembly engage together for at least partially connecting the wall panel to the wall structure.

15. The wall system according to claim 14, wherein the receiving plate of each wall connecting assembly comprises a back-wall portion and left and right vertical protections spaced-apart from each other and extending outwardly from the back-wall portion and toward each other, the left and right vertical projections and the back-wall portion partially delimiting together the receiving space.

16. The wall system according to claim 15, wherein the mounting plate of the first connector of each wall connecting assembly comprises left and right mounting grooves each extending along the substantial vertical direction from the upper edge to the lower edge of the mounting plate for slidably receiving the respective left and right vertical projections.

17. The wall system according to claim 14, wherein the mounting plate of each wall connecting assembly comprises an inner face facing the receiving plate when the mounting plate is within the receiving space of the receiving plate and an opposed outer face and wherein the first engaging portion comprises upper and lower projections extending from the outer face of the mounting plate.

18. The wall system according to claim 17, wherein each second connector comprises upper and lower wall portions for receiving the upper and lower projections of the first engaging portion therebetween.

19. The wall system according to claim 18, wherein the upper and lower projections are biased toward the respective upper and lower wall portions when the first and second engaging portions engage together.

20. The wall system according to claim 14, wherein the first and second connectors of each wall connecting assembly are shaped and dimensioned so that the inner face of the wall panel is substantially flush with the face of the wall structure when the wall panel and the wall structure are connected.

21. The wall system according to claim 14, wherein the first and second connectors of each wall connecting assembly are shaped and dimensioned so that the inner face of the wall panel is horizontally spaced apart from the face of the wall structure when the wall panel is connected to the wall structure.

22. The wall system according to claim 14, comprising a connecting panel to at least partially cover the face of the wall structure, the connecting panel comprising the plurality of receiving plates, and wherein the connecting panel is arranged between the wall structure and the wall panel when the wall panel is connected to the wall structure.

23. A method for covering a face of a wall structure, the method comprising:

mounting a receiving plate to the face of the wall structure, the receiving plate defining a receiving space and comprising a lower projection extending from a lower portion of the receiving plate;

providing a first connector comprising a mounting plate to be at least partially mounted within the receiving space and a first engaging portion extending from the mounting plate, the mounting plate extending along a substantial vertical direction from an upper edge to a lower edge;

mounting the first connector to the receiving plate by sliding the mounting plate along the substantial vertical direction within the receiving space toward the lower portion of the receiving plate and then by contacting the lower edge of the mounting plate against the lower projection such that the mounting plate is within the receiving space of the receiving plate, the first connector is connected to the receiving plate and the first connector is mounted to the wall structure;

providing a wall panel having a second connector being part of or being mounted to an inner face of the wall panel, the second connector defining a second engaging portion to register with the first engaging portion of the first connector; and engaging together the first and second connectors such that the wall panel is at least partially connected to the wall structure.

24. The method according to claim 23, wherein the receiving plate is a first receiving plate, the method comprising:

providing a connecting panel comprising the first receiving plate and a second receiving plate; and mounting the connecting panel to the face of the wall structure such that the connecting panel is arranged between the wall structure and the wall panel when the wall panel is connected to the wall structure.

* * * * *